US005257493A

United States Patent [19]

Cocchi et al.

[11] Patent Number: 5,257,493

[45] Date of Patent: Nov. 2, 1993

[54] METHOD AND MACHINE FOR PACKING ICE CREAM CONES

[75] Inventors: Giuliano Cocchi, Bologna; Gianni Zaniboni, S. Lazzaro di Savena; Angelo Righi, Casalecchio di Reno, all of Italy

[73] Assignee: Catta 27 S.r.l., Italy

[21] Appl. No.: 924,117

[22] Filed: Aug. 4, 1992

[30] Foreign Application Priority Data

Aug. 9, 1991 [IT] Italy ..... GE91A000104

[51] Int. Cl.[5] ..... B65B 35/56

[52] U.S. Cl. ..... 53/446; 53/142; 53/143; 53/251; 53/475; 53/544

[58] Field of Search ..... 53/446, 443, 473, 475, 53/544, 143, 142, 251, 250, 249

[56] References Cited

U.S. PATENT DOCUMENTS 4,498,273 2/1985 Colamussi ..... 53/143 X
4,555,892 12/1985 Dijkman ..... 53/142
4,694,637 9/1987 Bech et al. ..... 53/142 X
4,901,502 2/1990 Colamussi ..... 53/143

*Primary Examiner*—James F. Coan
*Attorney, Agent, or Firm*—Larson and Taylor

[57] ABSTRACT

The method of packing into boxes ice cream cones comprises the following operative steps: positioning of at least one basket (C) with the ice creams G, in position with at least one empty box (S) which is open upwards; lifting and removal of two parallel rows of ice creams from their seats in the basket; composite rotation of the two rows of ice creams, upwards and in opposite directions through 90°, so that on completion of said composite rotation said ice creams will be disposed with their axes in a horizontal condition, and with their tips at the outer side of the two rows and with their horizontal generatrix disposed perpendicularly with respect to the imaginary vertical plane containing the longitudinal axes of each row of ice creams; movement of the ice creams of each of the two rows towards each other; movement of the two rows of ice creams toward the box; introduction of one row into said box; introduction of the second row to form the second layer, whereby the tips of the ice creams in the first layer are disposed at one side of the box, while the tips of the ice creams in the second layer are disposed at the opposite side of said box, and whereby the tips and the tops of the second layer are arranged between the tops and the tips, respectively, of the ice creams in the first layer, and repetition of the steps.

12 Claims, 21 Drawing Sheets

METHOD AND MACHINE FOR PACKING ICE CREAM CONES

The invention relates to a method of and an automatic high-output machine for packing into boxes edible ice cream cones coming from the production cycle in the so-called baskets where they are arranged with their axes in a vertical condition, with their tips downwards and in a plurality of parallel rows.

The method of the present invention is characterized by the succession of the following operative steps:

lifting and removal of two parallel rows of ice cream cones from their seats in the baskets, wherein each row comprises a number of ice cream cones which is required to form at least one layer in a box;

90° rotation of the two rows of ice cream cones, upwards and in opposite directions, so that, on completion of said rotation, the tips of the ice cream cones will be disposed at the outer side of the two rows. The rotation of the ice cream cones occurs on axes which are inclined with respect to the longitudinal axes of the two rows, whereby on completion of the rotation, the ice cream cones of each row will have horizontal and parallel generatrices which are perpendicular to the imaginary vertical plane which contains said inclined rotational axes;

the ice cream cones of each of the two rows are moved towards each other and are pre-arranged according to a mutual spacing and plan view outline as required for packing in a box;

transfer of the two rows of ice cream cones toward a box, whereafter one row of said ice cream cones is introduced into said box;

once the first row of the ice cream cones has been packed into a box to form a first layer, the second row of ice cream cones is introduced into the box to form the second layer. The tips of the ice cream cones of the first layer are disposed at one side of the box, whereas the tips of the ice cream cones of the second layer are disposed at the opposite side of said box. The tips and the tops of the second layer ice cream cones are arranged between the tops and the tips, respectively, of the first layer ice cream cones;

repetition of the steps listed above until the box has been filled completely, the ice cream cones of the odd layers (first, third, etc.) being superposed on each other and the ice cream cones of the even layers (second, fourth, etc.) being superposed on each other.

Preferably, the cycle of packing into the boxes is concerned with a plurality of baskets at a time and, therefore, each cycle involves a plurality of boxes simultaneously, thus improving the output of the machine that operates according to the invention. In this instance, each row of ice cream cones removed from the baskets comprises the ice cream cones which are required to form a layer in each of the boxes which are concerned simultaneously in each operative cycle of the machine.

Further characteristics of the invention and the advantages resulting therefrom will become apparent from the following description of a preferred embodiment thereof, shown merely as a non-limiting example in the Figures of the accompanying drawings, in which.

Figure 9A:
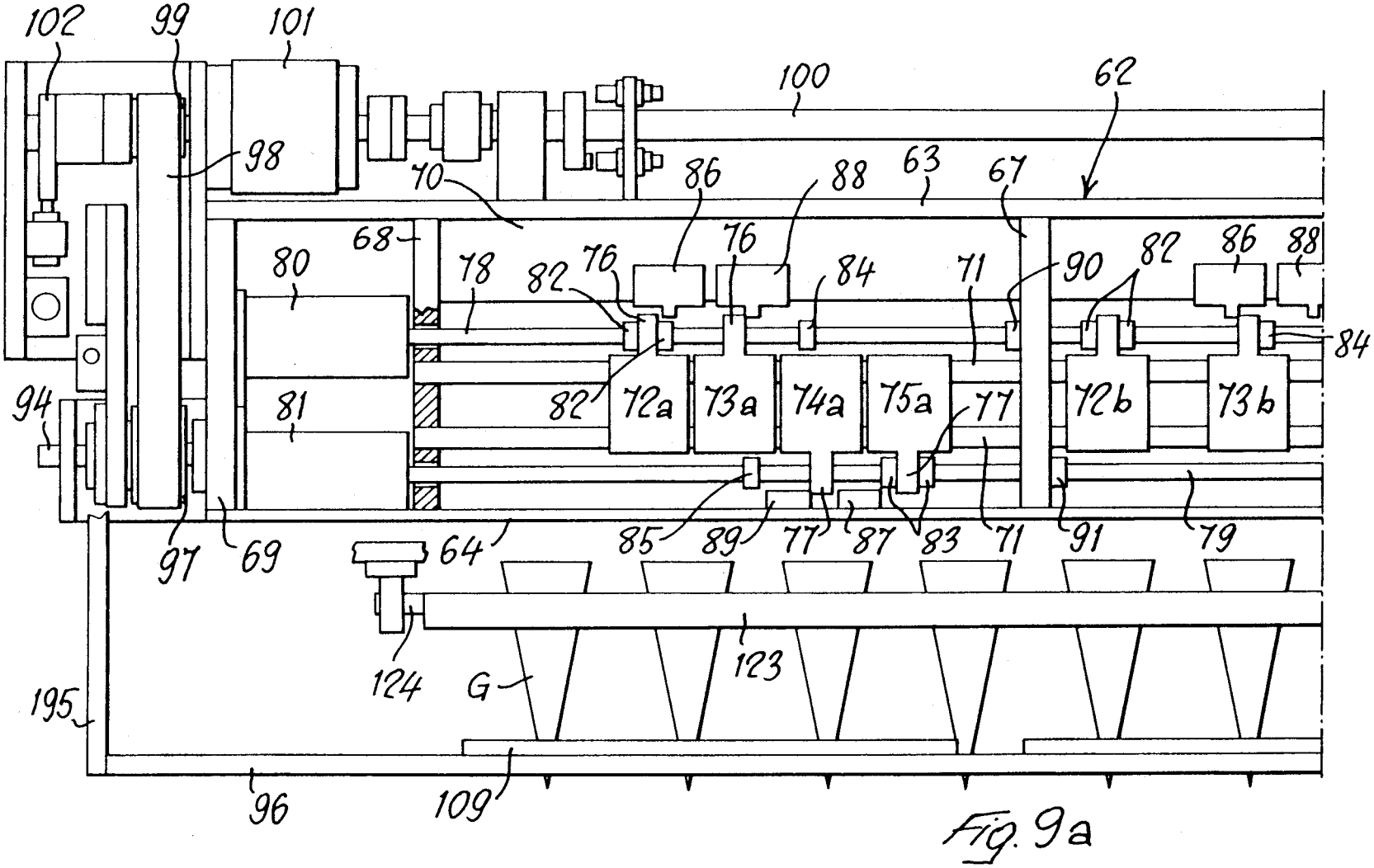
Figure 9B:
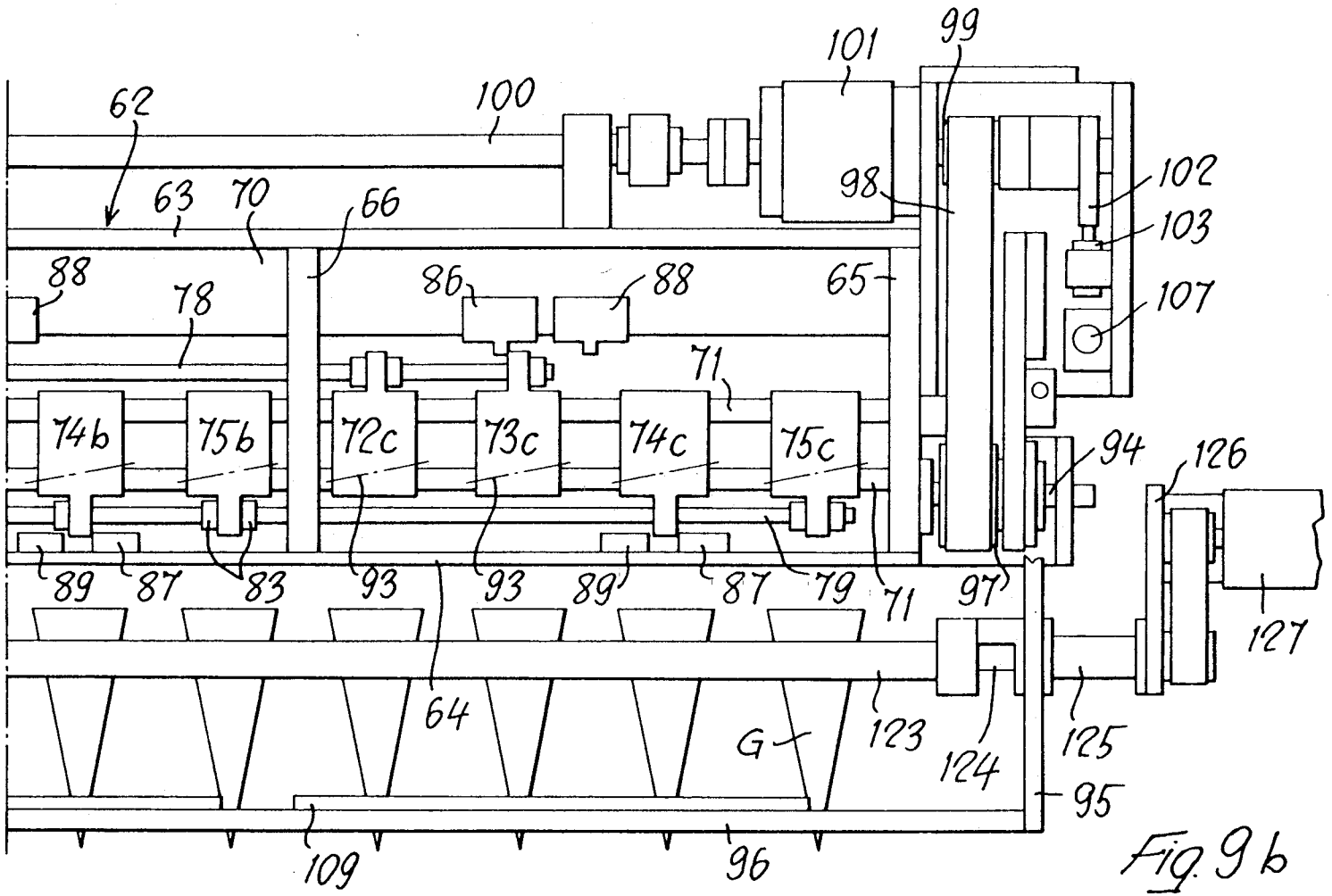
Figure 10:
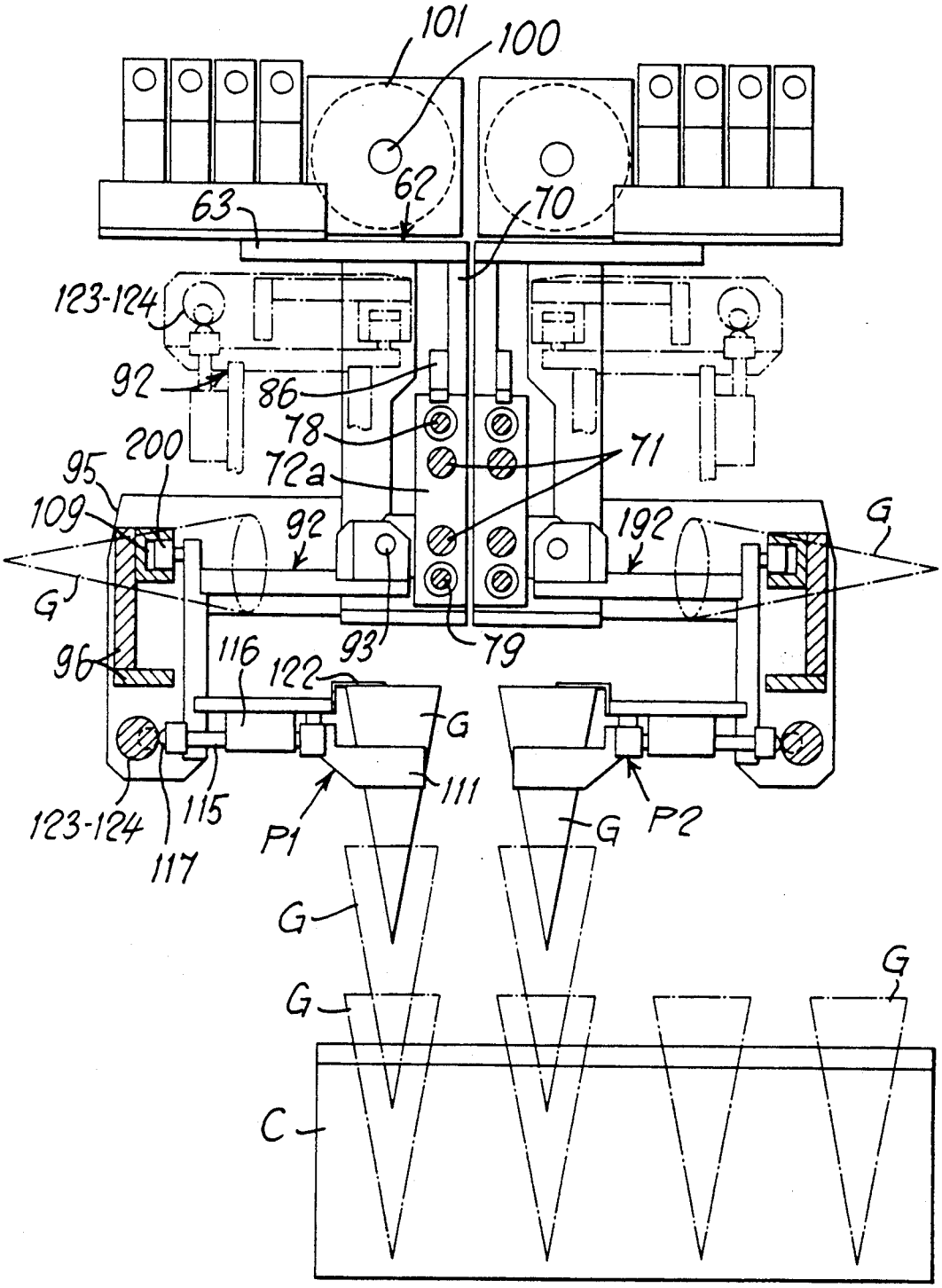
Figure 11:
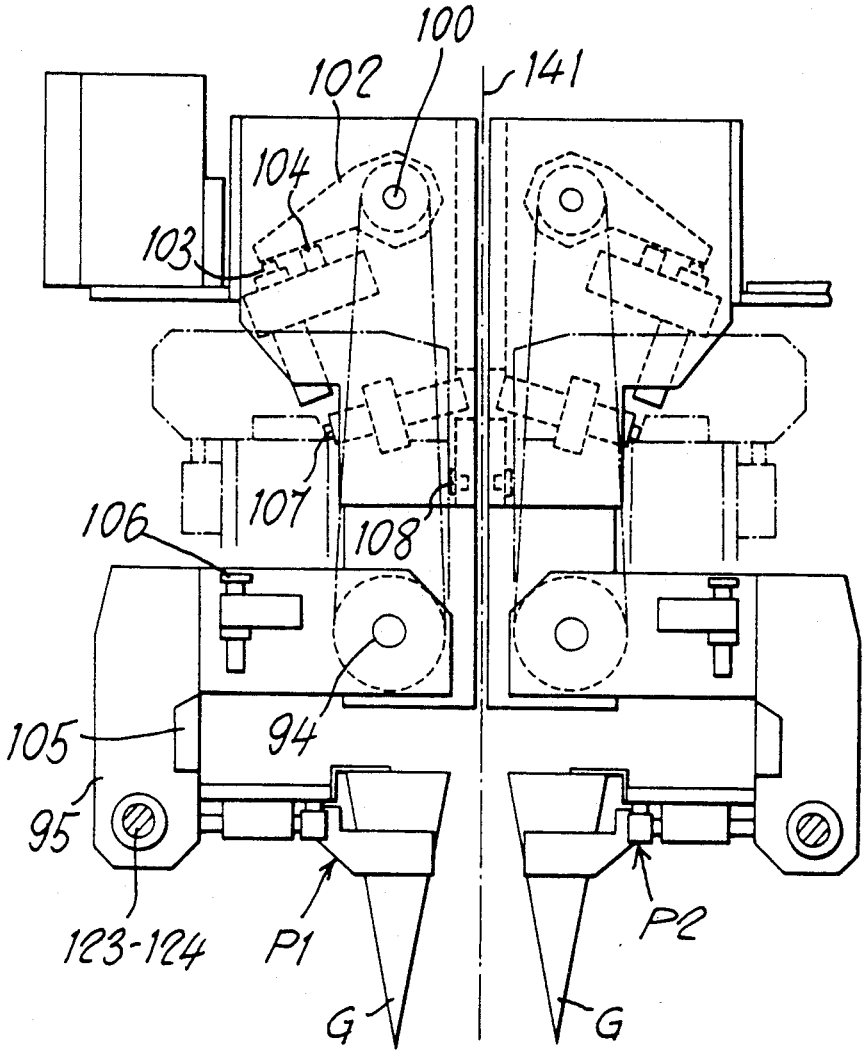
Figure 12:
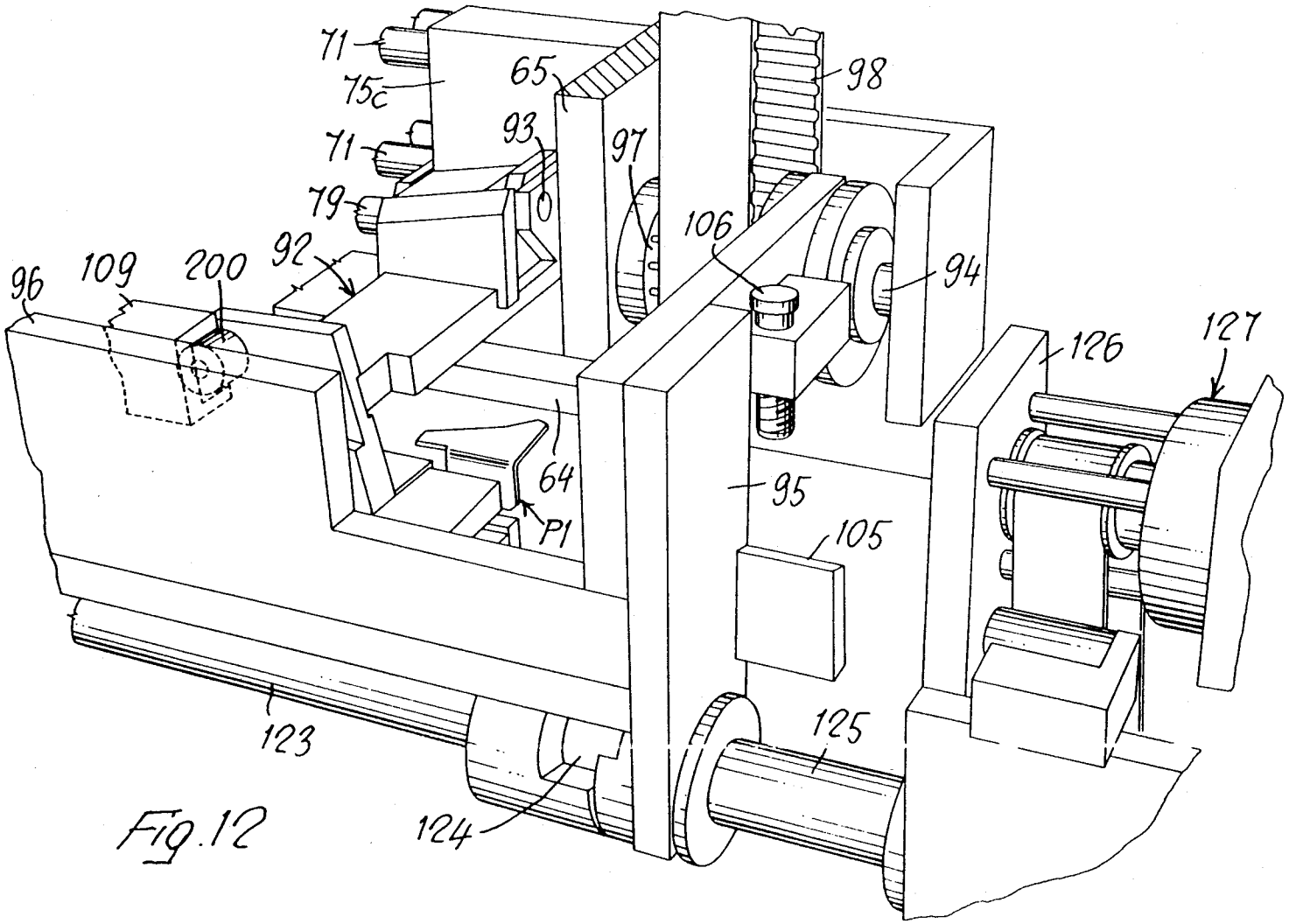
Figure 14:
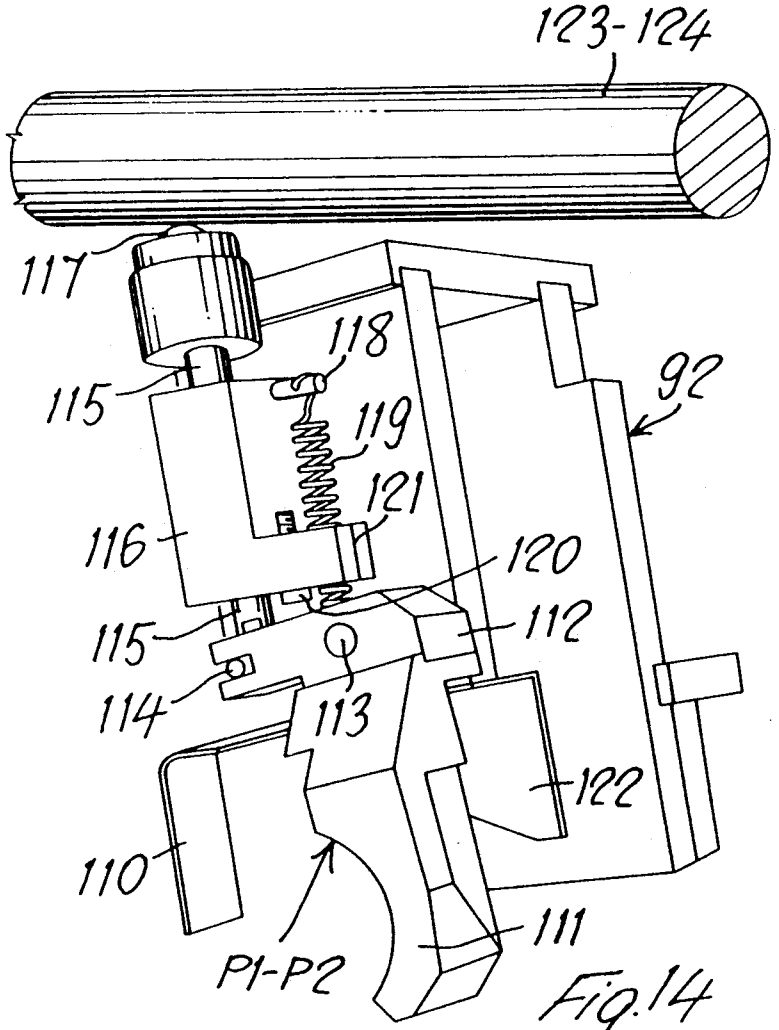
Figure 13:
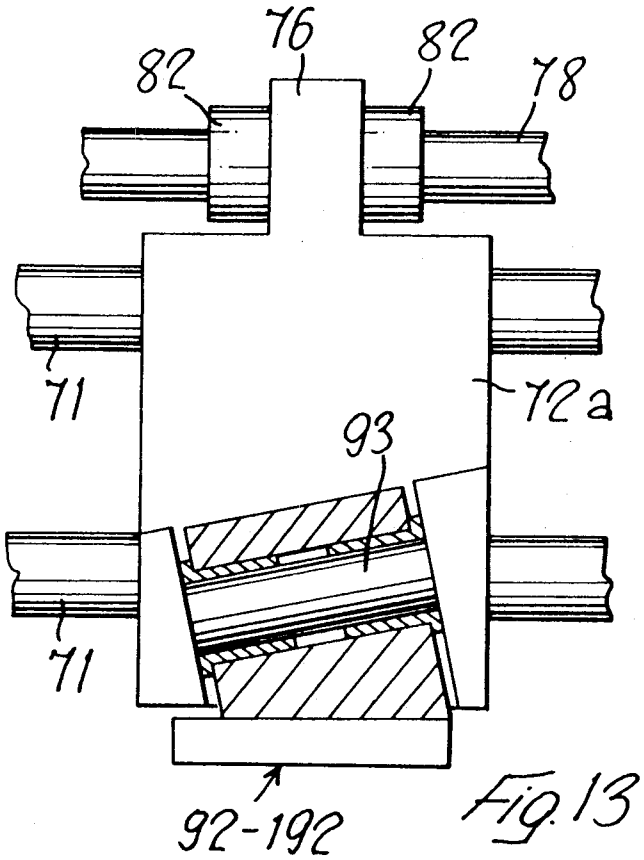
Figure 15:
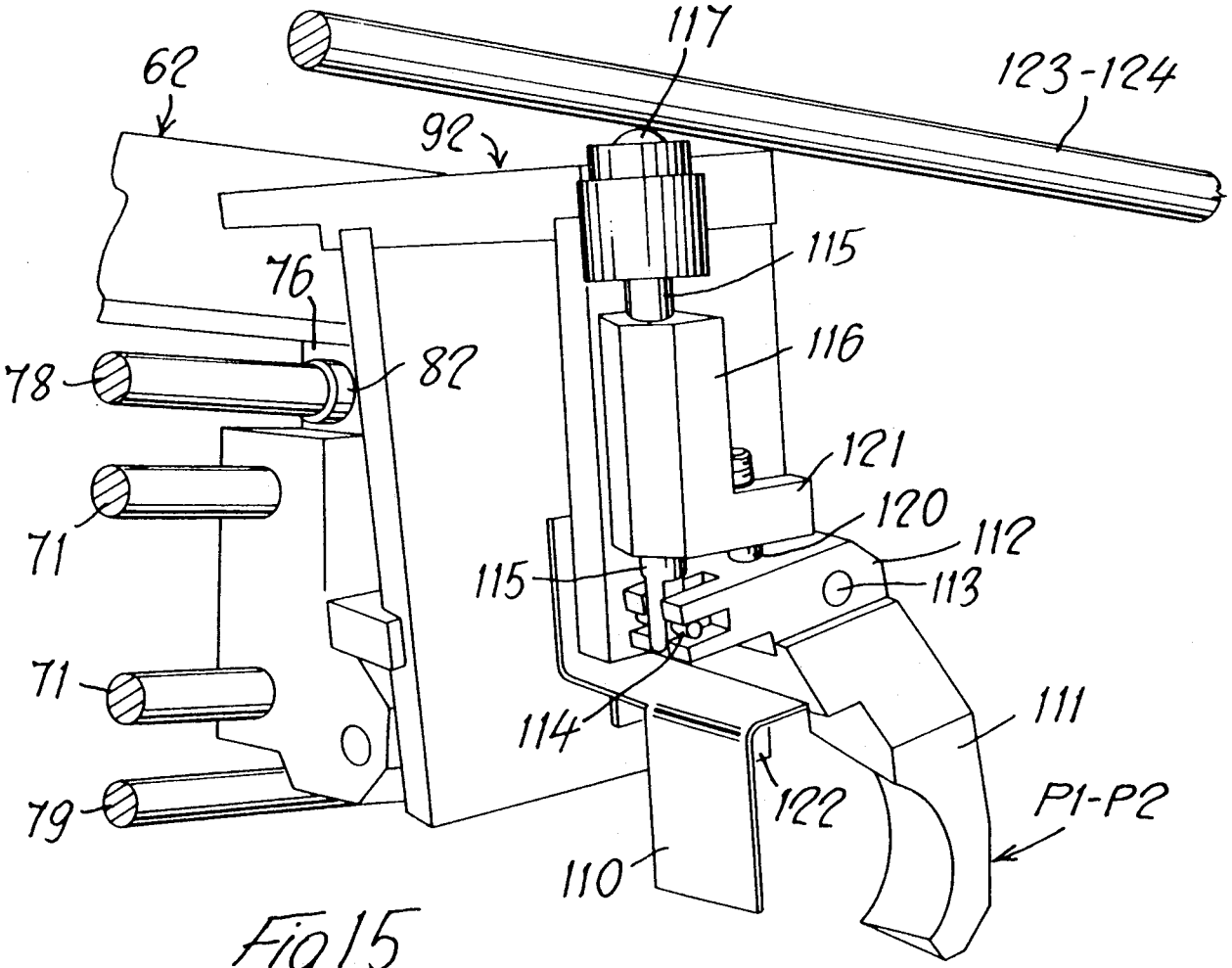
Figure 16A:
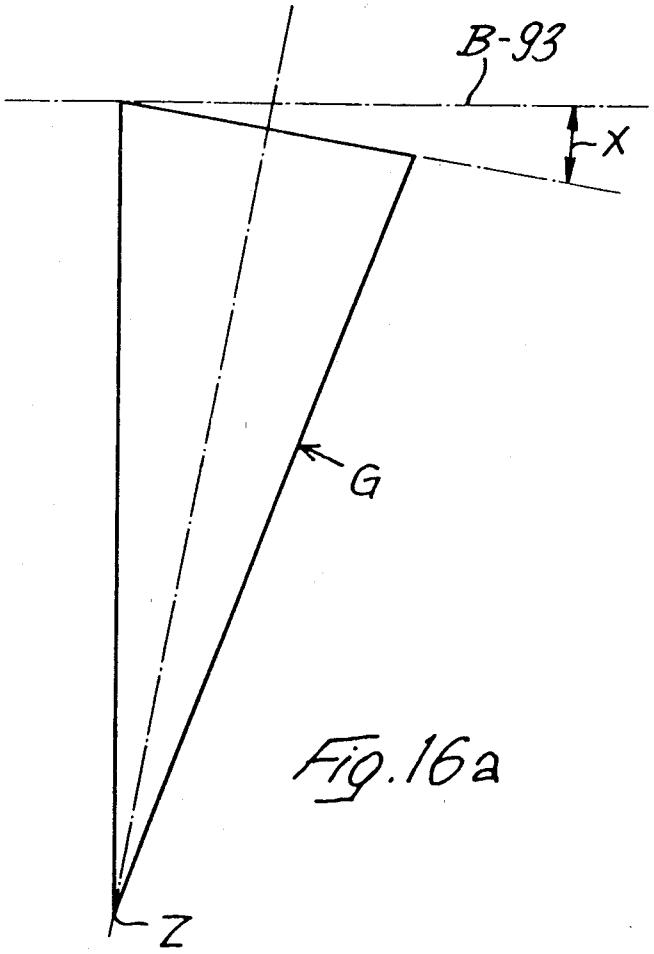
Figure 16:
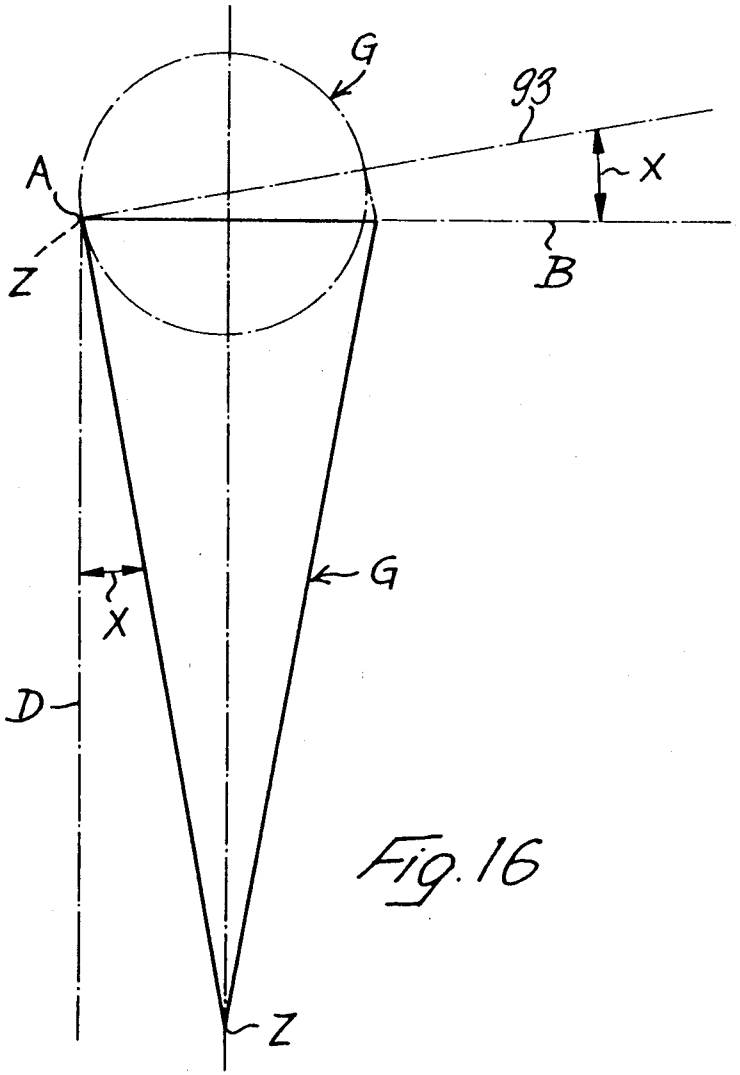

FIG. 9, which is shown in two parts designated FIG. 9*a* and FIG. 9*b*, is a side elevational and partly sectional view of the group of sliding blocks for transferring one of said two rows of grippers for handling the ice cream cones;

FIGS. 10 and 11 are front elevational views showing, in the two operative positions, the two rows of grippers for handling the ice cream cones;

FIG. 12 is a perspective view of one of the ends of a pivotable structure which effects the reciprocating rotation of one of the two rows of grippers for handling the ice cream cones;

FIG. 13 is an enlarged elevational and partly sectional view, as from FIG. 9, showing the skew connection between the body of each gripper for handling the ice creams to the respective transfer sliding block;

FIGS. 14 and 15 are perspective views, from two different angular standpoints and in the raised or rotated upwards position, of one of the grippers for handling the ice cream cones;

FIGS. 16 and 16*a* are side elevational and top plan views, respectively, showing the movements imparted to the ice cream cones by the handling grippers;

FIGS. 17-18-19-20-21-22 are front elevational views of the groups for handling the two rows the ice cream cones, in as many significative steps of the cycle for packing four layers of ice cream cones into a box;

FIGS. 23-24-25-26 are perspective views of four grippers for handling ice cream cones, in the successive steps of upwards rotation of the ice cream cones, mutual approaching of said ice cream cones, transfer and introduction of said ice cream cones into a packaging box.

Figure 2:
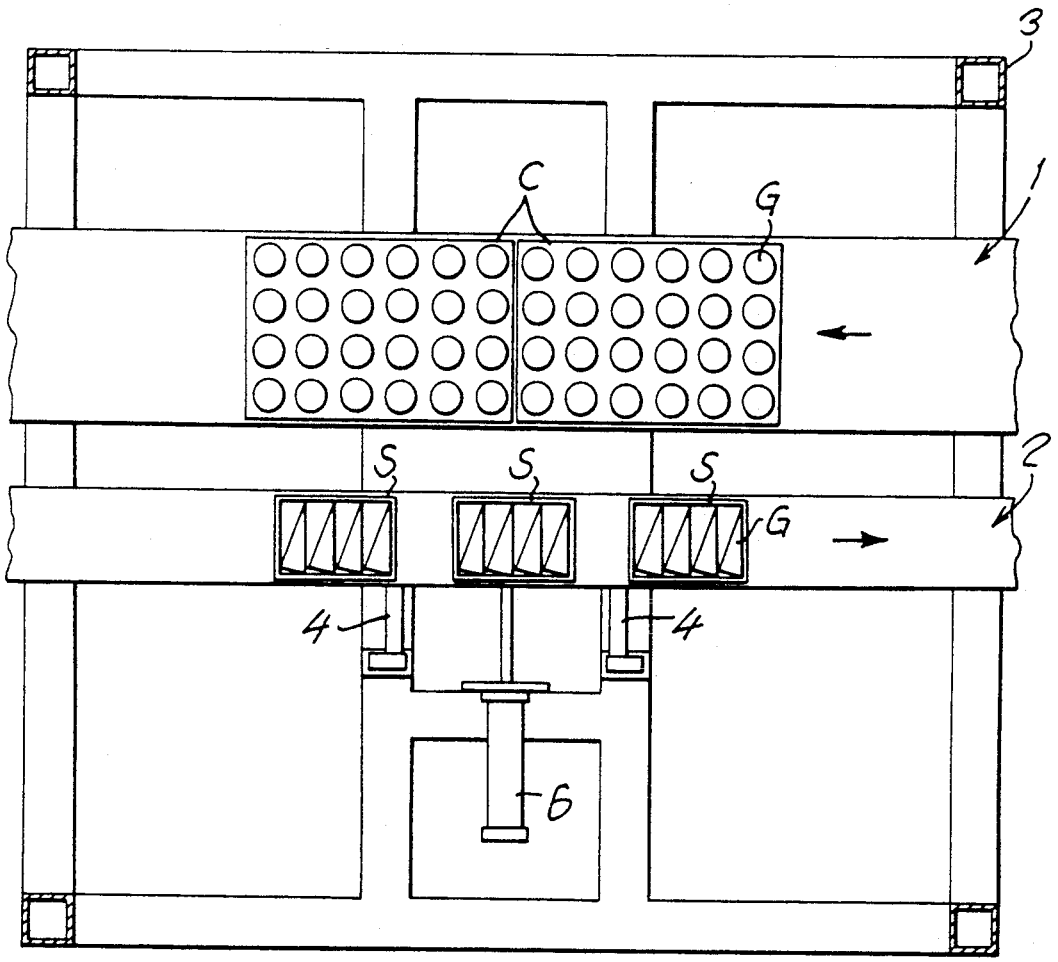
FIG. 2 is a top plan view of the frame of the machine, of the conveyor for the baskets with the ice cream cones, and of the conveyor for the boxes wherein said ice creams shall be packed.
Figure 3:
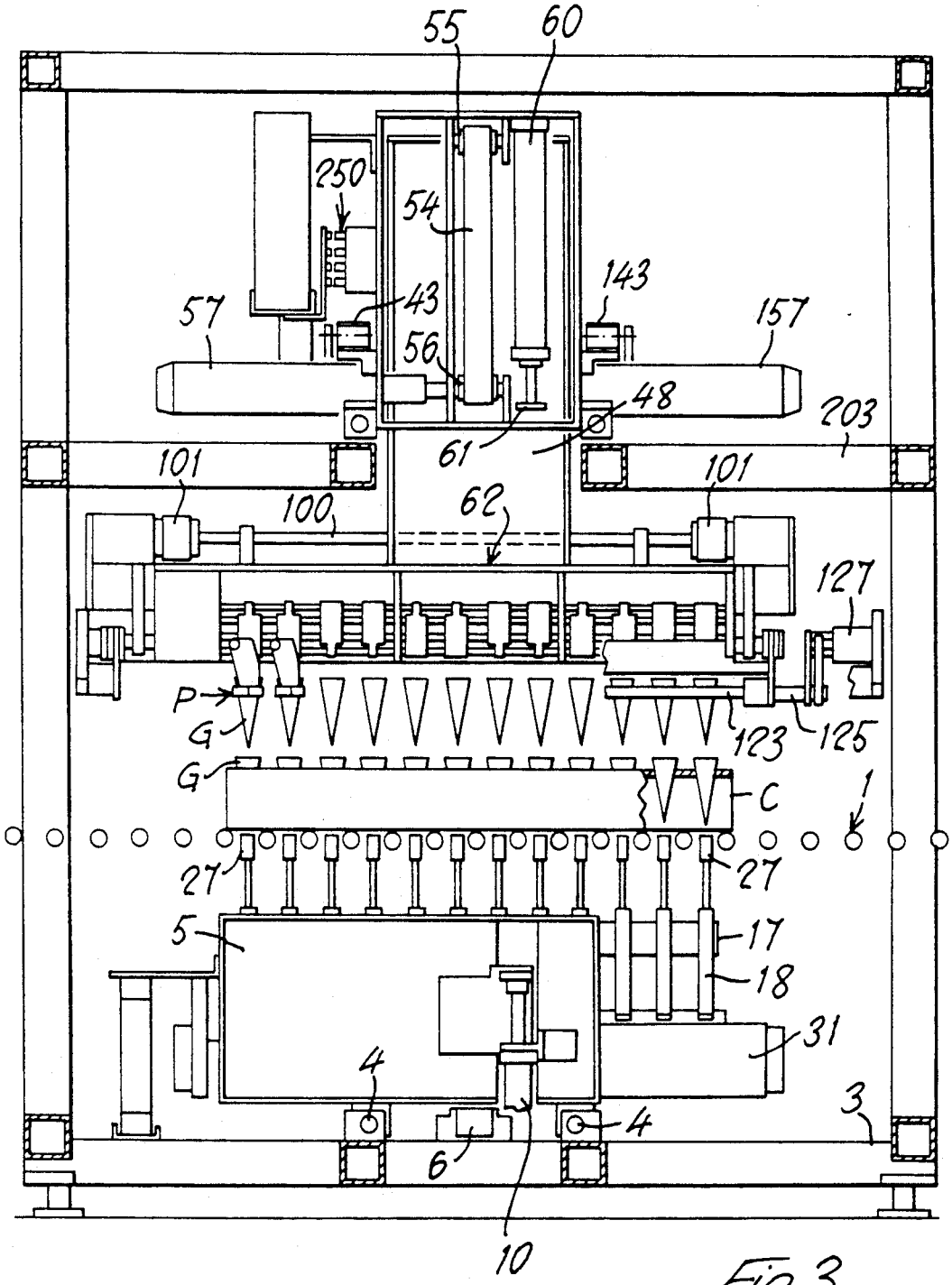
FIGS. 3 and 4 are side elevational and front elevational views, respectively, of the machine.
Figure 4:
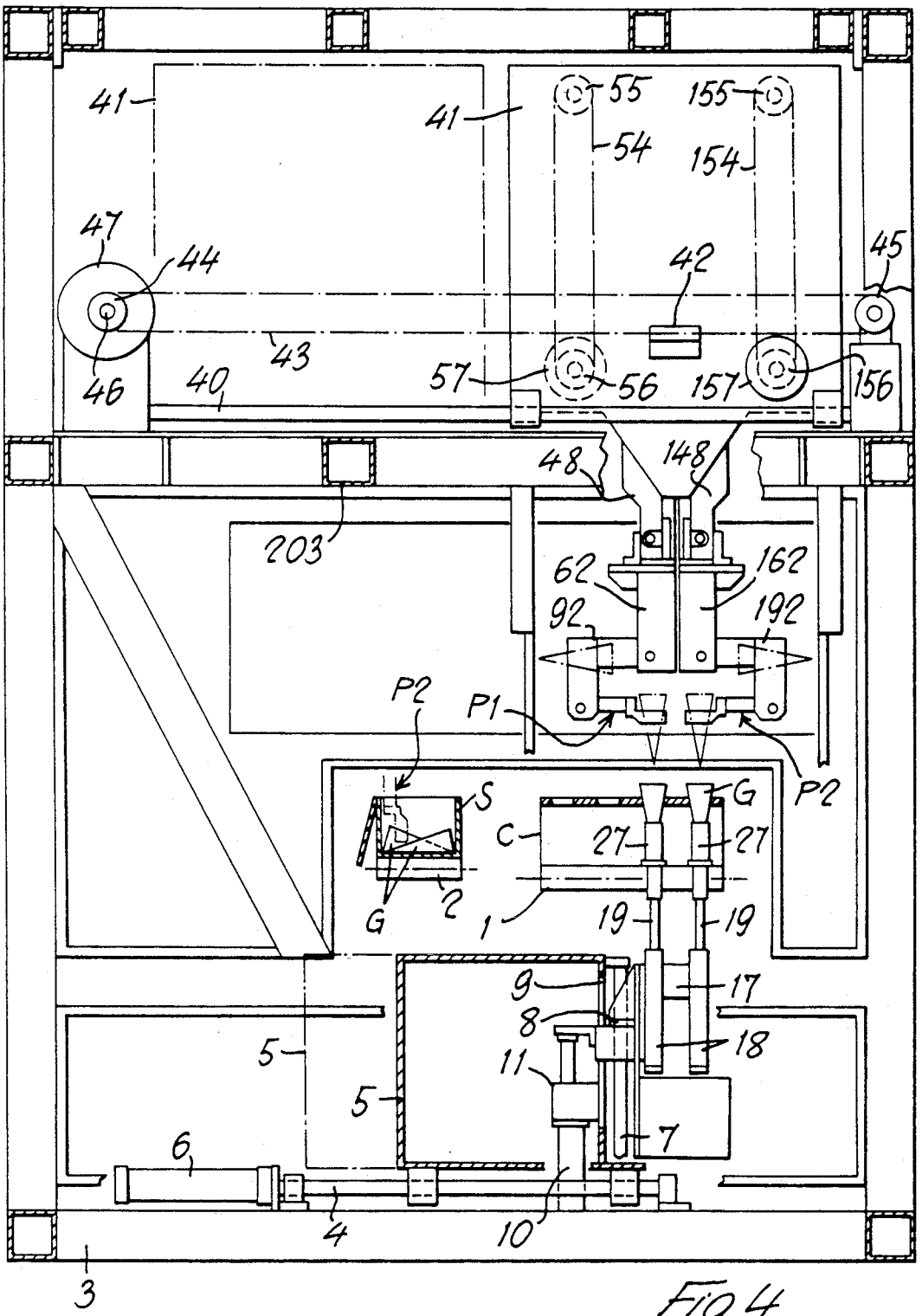

FIGS. 2-3-4, the numerals 1 and 2 indicate the horizontal, parallel, side-by-side conveyors whereby the conventional type baskets C containing ice cream cones G, and the boxes S for packing said ice cream cones are introduced into and removed from the machine being discussed. The conveyor 2 introduces the boxes S into the machine with their open sides upwards, in a single file, equally spaced apart as pre-established, in a suitable number (for example, in the number of three), and stops them in a pre-established position. The conveyor 1 introduces the baskets C into the machine in single file, in a suitable number (for example, in the number of two) and stops them in a pre-established position which is centered with respect to the boxes S. In this instance, the assembly of the two baskets C positioned in the machine comprises four parallel longitudinal rows of ice cream cones, each comprising twelve ice cream cones arranged in a known manner, with their axes in a vertical condition and with their tips directed downwards. The boxes S can accommodate four layers of ice cream cones, each comprising four ice cream. Each of said longitudinal rows of ice creams in the two baskets C, comprising twelve ice cream cones, is used to constitute simultaneously one layer of ice cream cones in the assembly of three boxes S positioned in the machine.

The means for correctly positioning and retaining the boxes S and baskets C in the machine as described above are not considered herein because they may be easily conceived and constructed by those skilled in the art.

Figure 7:
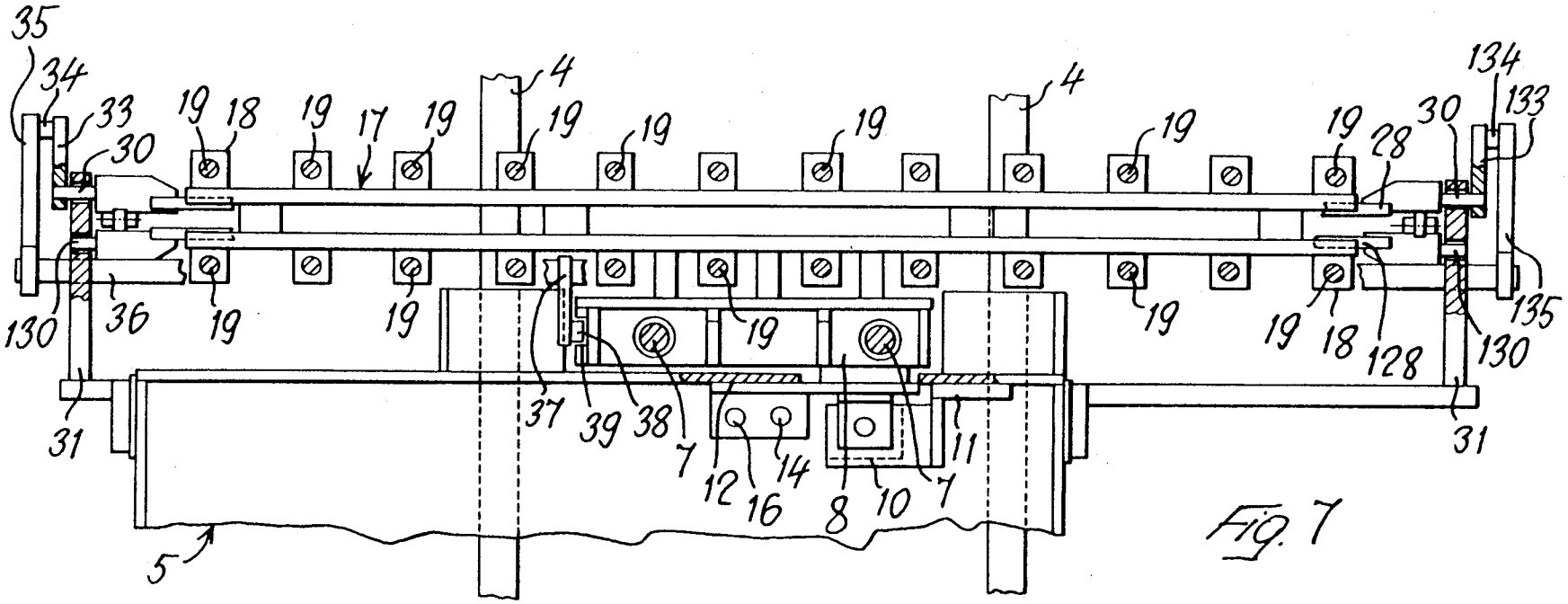

It will be noted in FIGS. 2-3-4-6-7-8 that, under the conveyors 1-2, orthogonally thereto, the frame 3 of the machine carries horizontal, rectilinear guides 4 whereon a carriage 5 slides by the action of a fluid-operated, double-acting cylinder and piston unit 6. It is to be understood that the carriage 5 may have a different shape other than the box like configuration shown herein. Secured on the front side of the carriage 5 are vertical guides 7 whereon a slide 8 can slide; a projection of said slide extends through an opening 9 formed in the near wall of the carriage 5, for connection to a rod of a fluid-operated cylinder and piston unit 10, secured to the body of said carriage 5 by means of a support 11. In FIG. 7 it is also to be noted that, secured on the slide 8 connected to the cylinder 10, is a plate 12 carrying decelerators 13-14 and limit stops 15-16.

In FIGS. 4-7-8, more particularly, it is to be noted that secured on the slide 8 is the intermediate portion of a horizontal composite beam 17, parallel to the conveyors 1-2, on the sides of which there are secured vertical guides 18 in the number of twelve guides each side, spaced apart by the same distance existing between the ice cream cones of two longitudinal near rows in the baskets C. Slidably mounted in the guides 18, are vertical rods 19 having secured at its lower end a base member 20 which is kept in abutment against the lower end of said guides by means of springs 21 which are anchored to said base members and slides. The rods 19 are prevented from rotating due to the co-operation of a longitudinal groove thereof 22 with a key-like pin 23 secured to each guide 18. This is necessary in order that the base members 20 of the two rows of rods keep directed towards the inner space between said rows thanks to a detent 24 thereon to be discussed below.

Figure 8:
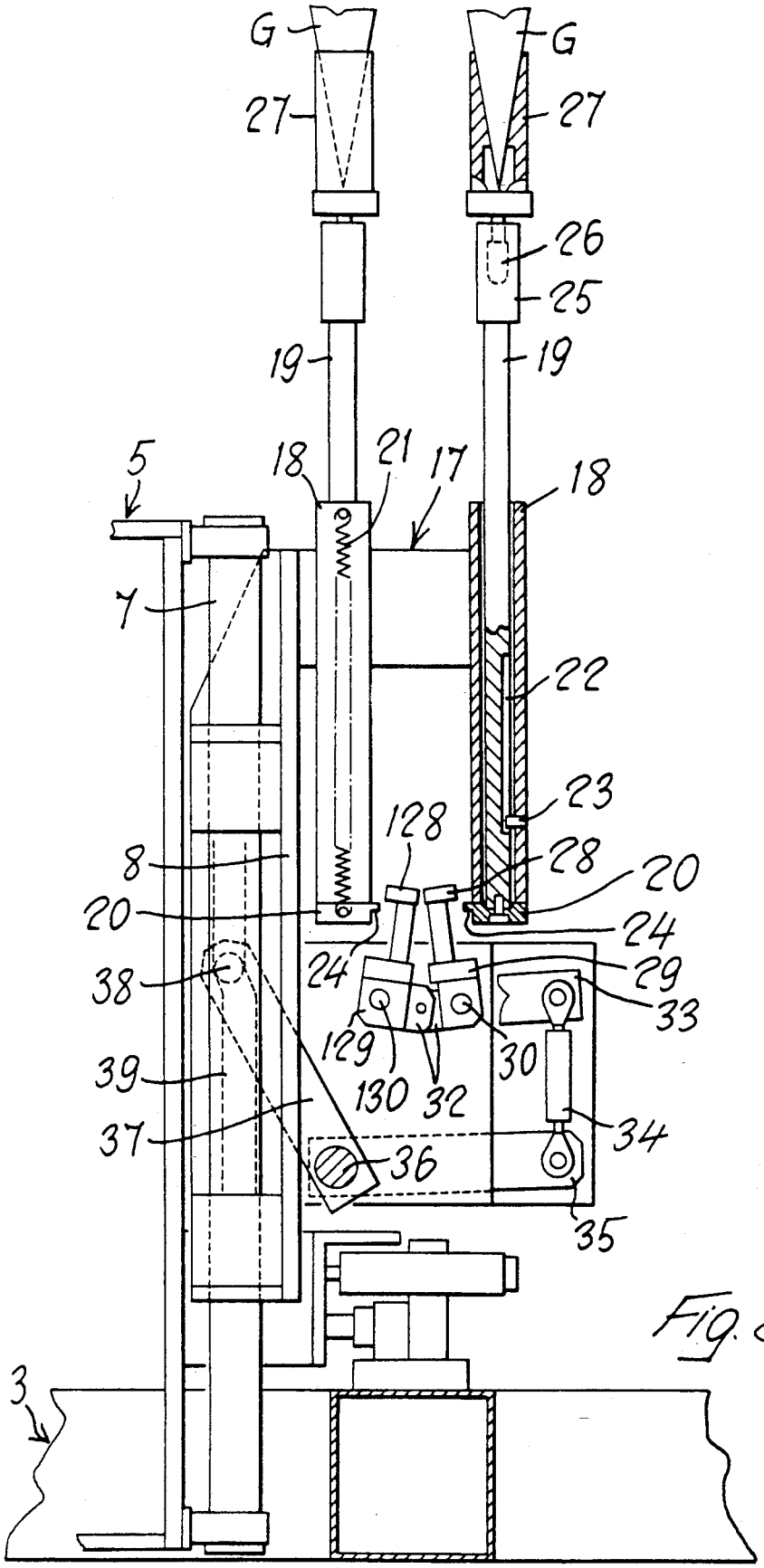
FIG. 8 is a front elevational and partly sectional view of the group of elevators shown in FIGS. 6 and 7.

Again in FIG. 8, it is to be noted that mounted on the top end of each rod 19 are bushes 25 which support, through the intermediary of a small ball joint 26, a respective interiorly-conical cup member 27.

The device described above operates below the baskets C which have been positioned in the machine and lifts two adjacent rows of ice cream cones G by supporting them at the tip by means of said cup members 27. The unit 6 causes the carriage 5 to slide and positions the two rows of cup members 27, in a lowered position, axially in line with the two longitudinal rows of ice cream cones to be withdrawn from the baskets C which are retained in the machine by suitable means (not shown). Under command, the unit 10 lifts the two rows of cup members to cause the desired lifting of the ice cream cones and to position them for being gripped by the handling grippers described below. Thanks to the articulated motion permitted by the members 25-26, the cups 27 will match the ice cream cones to be lifted. It may occur that some of the ice cream cones is sticked in the seat of the basket due to the presence of ice. When the cups 27 reach the co-operating condition with the ice cream cones G, the detents 24 are positioned at a short distance below the bars 28-128 which, with a suitable delay with respect to the lifting of the assembly 18-19, are moved outwards. If the ice cream cones have been normally lifted, the bars 28-128 do not interfere with the detents 24 of the lifted equipments. However, if a few ice cream cones are sticked to a basket C and keep down the cup 27 with the rod 19 and base number 20, against the action of the springs 21 which will be loaded progressively, said bars 28-128 superimpose the detents 24 of said base members, which have remained in their lower position, so as to avoid that, should an ice cream separate abruptly from the basket, it may be thrown upwards by the release of the previously-loaded springs 21. Before the lifting cups return to their lowered position to start a new cycle, the bars 28-128 are approached to each other so as to avoid interferring with the descent of the detents 24 of the equipment normally lifted previously.

The mechanism for actuating the bars 28-128 is shown in the FIGS. 7 and 8. Said bars, which have an inverted "L" configuration, are supported at the ends by supports 29-129 which are rotatably mounted on shafts 30-130 which are parallel to each other and to said bars and which, in turn, are sustained by the side frames of a structure 31 which is secured to the carriage 5. The shafts 30-130 are interconnected by levers 32-132 for self-centering motion. The shafts 30 of a bar are provided with respective angled levers 33-133 which are connected by tierods 34-134 to levers 35-135 which are connected perpendicularly to the ends of a shaft 36 which is parallel to said bars and is rotatably supported by the side frames of the structure 31. Secured perpendicularly to the intermediate portion of the shaft 36 is a lever 37 which through an end roller 38 follows the profile of a suitably shaped cam 39, arranged at one side of the slide 8. Therefore, the movement of the safety bars 28-128 is caused by the same ascending and descending movement of the cups 27 for lifting the ice cream cones.

Figure 5:
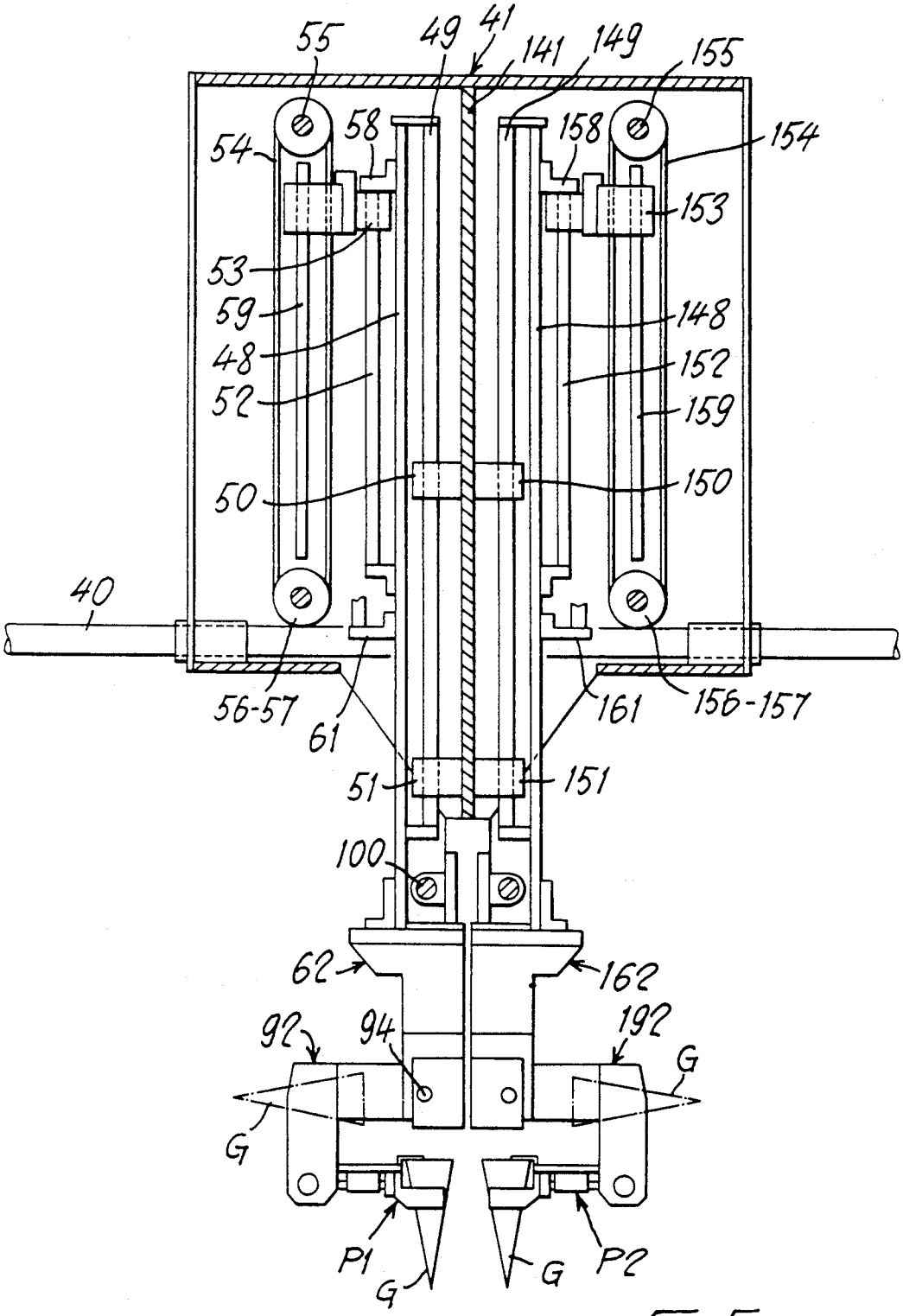
FIG. 5 is a front elevational and partly sectional view of the trans-elevator unit carrying the two rows of grippers for handling the ice cream cones.
Figure 6:
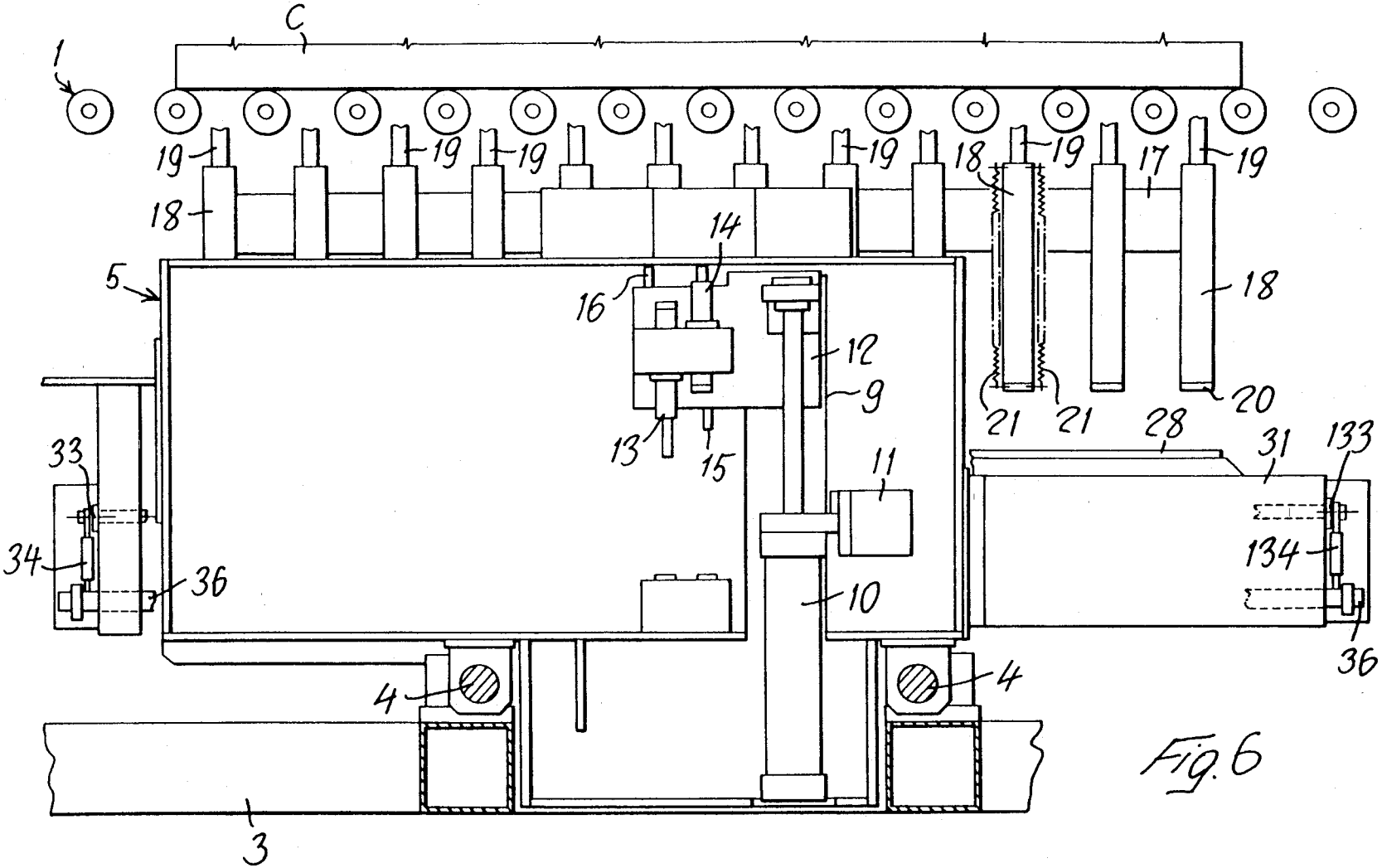
FIGS. 6 and 7 are side elevational and top plan views, respectively, of the two rows of elevators to lift the ice cream cones initially from the respective baskets.

From the FIGS. 3-4-5, it can be seen that the base frame of the machine is of parallelepipedal configuration and comprises, above the conveyors 1-2, a horizontal frame 203 supporting a pair of horizontal guides 40 which are parallel both to each other and to said lower guides 4. Slidable on the guides 40 is a box-type carriage 41 which is connected laterally at 42 to one of the flights of a pair of parallel toothed belts 43-143 which are turned around toothed wheels 44-45 on one of which wheels said belts are interconnected by a drive shaft 46 which is actuated by an electronically-controlled, precision-type geared motor 47 provided with a brake. More particularly, in FIGS. 5 and 3 it can be seen that two side-by-side slides 28, 148 supporting the rows of grippers for handling the ice cream cones are movable vertically and with precision on the carriage 41. Said slides are provided with respective pairs of vertical guides 49-149 which are slidable with precision in supports 50-150 and 51-151 which are secured to the opposite faces of an intermediate vertical wall 141 of the carriage 41. Said slides 48-148 carry further vertical guides 52-152 wherein there are slidably mounted carriages 53-153 which are connected to the flights of respective toothed belts 54-154 turned around toothed wheels 55-155 and 56-156 which are supported by the carriage 41, the lower ones being actuated by respective electronically-controlled geared motors 57-157 having an incorportated brake, protruding from the opposite sides of the carriage 41 (FIG. 3). The upper supports 58-158 carrying the guides 52-152, normally rest on the carriages 53-153 and follow due to gravity the descending movement thereof so that, should the descent of the slides 48-148 be obstructed by any obstracle, the actuators of said slides may operate unhindered.

In order to grant the precision movement of the carriages 53–153, the latter are provided with projections which. via rolling means, co-operate with guides 59–159 secured to the side frames of the carriage 41.

Since the weight of the slides 48–148 and parts associated therewith is of considerable amount, means are provided to partly compensate for said weight, so as to reduce the effects of inertia in the movement of said equipment and to increase their operative speed. Said compensation is effected by fluid-operated cylinder-and-piston units 60, one for each slide 48–148 to which their rods are connected at 61–161, the body of said units being secured to the carriage 41.

Secured to the lower end of each slide 48–148 is the intermediate portion of the respective horizontal frames 62–162 carrying the rows of grippers for handling the icecreams. Since said frames, grippers and respective drives, associated with each of the slides 48–148, are equal to each other, the following description will be referred only to the means associated with the slide 48 (see FIG. 9).

The frame 62 comprises a horizontal plate 63, secured to the slide 48, and an underlying plate 64 parallel to the plate 63 and connected thereto by means of crossmembers 65-66-67-68-69. A plate 70 is secured edgewise to the lower side of the plate 63. The crossmembers 65-66-67-68 are equally spaced apart and support a pair of rectilinear and parallel guides 71 whereon three groups of four sliding blocks 72*a*–73*a*–74*a*–75*a*, 72*b*–73*b*–75*b*, 72*c*–73*c*–74*c*–75*c* slide with precision. The sliding blocks 72*a*–73*a*, 72*b*–73*b*, 72*c*–73*c* are integrally provided with a respective lug 76 directed upwards, whereas the other sliding blocks are integrally provided with a corresponding lug 77 directed downwards. The upper lugs 76 are traversed by a rod 78, whereas the lower lugs 77 are traversed by another rod 79, said rods 78–79 being parallel to the guides 71 and pre-arranged to freely traverse the crossmembers 66-67-68 and being connected to respective fluid-operated double-acting cylinder-and-piston units 80–81 arranged between the crossmembers 68 and 69 and secured to the last-mentioned crossmember. The upper lugs 76 of the sliding blocks 72*a*–72*b*–72*c* and the lower lugs 77 of the sliding blocks 75*a*–75*b*–75*c* are secured to the respective rods 78–79, for example, by pairs of retainers 82 and 83. When the machine being discussed is about to begin its cycle, the sliding blocks are equally spaced apart by the same extent as the ice creams arranged in the baskets C as from FIG. 2, as emphasized in FIG. 9 in connection with the sliding blocks of the groups "b" and "c". The rods 78 and 79 are provided with shoulders 84 and 85 which keep the lugs 76 and 77 of the sliding blocks 73*a*–73*b*–73*c* and 74*a*–74*b*–74*c* against stops 86 and 87 which are secured to the plates 70 and 64, respectively.

During a step of the operative cycle of the machine, the sliding blocks are brought together into a bundle to gather the ice cream cones to be packed into the boxes (see below), as shown in connection with the sliding blocks of the group "a" in the same FIG. 9. In this instance, as a result of the displacement of the rods 78–79, the sliding blocks 72*a*–72*b*–72*c* will be brought into contact with the adjacent sliding blocks 73*a*–73*b*–73*c* and displace them as far as the lugs 76 of the latter engage the stops 88 which are fixed to the plate 70, while the sliding blocks 75*a*–75*b*–75*c* will be brought into contact with the adjacent sliding blocks 74*a*–74*b*–74*c* and bring the lugs 77 of the latter against stops 89 which are fixed to the plate 64. In this step, the displacement of the rods 78–79 is also controlled by the engagement of shoulders 90–91, fixed to said rods, against the crossmembers 67.

With reference to FIGS. 3-4-5-9-10-11-12-13-14-15, it will be noted that the sliding blocks mentioned above are pre-arranged to be articulated with their outer faces to the ends of respective composite U-shaped structures 92, by means of respective cylindrical articulated joints 93 lying in a common imaginary vertical plane and which are inclined in the same direction and by the same extent with respect to an imaginary horizontal plane. This inclination is the same or substantially the same as that of the generatrix of the conical ice cream G and the axis of said ice cream. In the example being discussed, said inclination is about on the order of ten degrees.

The end portions of the frame 62 support two shafts 94 aligned to each other and parallel to the longitudinal axis of said frame, and said shafts rotatably mount respective L-shaped arms 95–195 (see also FIG. 12) which are interconnected, at the sides remote from said rotational axes, by a suitably ribbed plate 96. The arms 95–195 have affixed thereto, co-axially to the shafts 94, toothed pulleys 97 which, via toothed belts 98, are connected to further toothed pulleys 99 keyed on a drive shaft 100 which is rotatably supported by the upper portion of the frame 62 and is actuated by one or more motors 101 of any suitable type. Perpendicularly secured to the ends of the shaft 100 are levers 102 which, when the structure 95–195–96 is in the position shown in FIG. 11 by solid lines, co-operate with respective decelerators 103 and limit stops 104 supported by the frame 62. When the structure 95–195–96 is in the position shown in FIGS. 10 and 11 by broken lines, and has rotated through 90° upwards, on the horizontal axis 94, the limit stops 105 and 106 secured to the end portions of the structure 95–195–96 co-operate with the respective decelerators 107 and limit stops 108 supported by the frame 62.

FIGS. 9-10-11-12 show that longitudinally secured to the plate 96 are U-shaped guides 109 aligned to each other, co-operating with a roller 200 mounted on the most overhanging portion of the structure 92 of each gripper which, thus, follows the pivotal movements of said structure 95–195–96.

The end portion of each structure 92 mounts a gripper P1 which, as shown in FIGS. 10–14 and 15, comprises:

a jaw 110 made of suitably-shaped metal strip and pre-arranged to operate about tangentially on a portion of the side surface of an ice cream G. This jaw is secured to the structure 92;

a jaw 111 obtained by a casting process, exteriorly coated with non-adhesive material and so shaped as to co-operate with a portion of the side surface section of an ice cream that is gripped by the other jaw 110. The jaw 111 is secured to the end of a lever 112 inter-fulcrumed at 113 to the structure 92 and the other end of which is fork-shaped for pivotal connection by means of a pin 114, to a rod 115 which is axially slidable in a small guide 116 secured to the structure 92, the other end of said rod protruding from said guide and being provided with a spherical collar 117. Secured to the lever 112 and to the connection member 118 on the guide 116 are the ends of a spring 119 which urges the jaw 111 in the closing direction. In the closed condition, the lever 112 co-operates with an adjustable stop 120 carried by an extension 121 of the guide 116, which is of clamp-like configuration;

a small plate member 122 arranged perpendicularly above said jaws, at a suitable distance therefrom, secured to the structure 92 and adapted to co-operate with the top of an ice cream G.

The spherical collars 117 of the rods of the various grippers P1, co-operate with a shaft 123 which is parallel to the shaft 94–94' and supported at the ends, so as to be rotatable about an eccentric axis 124, by the side frames of the pivotable structure 95–195–96. Flanged on an end portion structure is a sleeve 125 with a plate 126 supporting a small drive unit 127 for rotating said eccentric shaft. Suitable sensors (not shown) are provided to stop the rotation of the eccentric shaft 123–124 in the two positions corresponding to the opened and the closed positions of the grippers P1.

The grippers associated to the vertical slide 148 are equal to the grippers P1 and are indicated at P2. The structures 192 supporting the grippers P2 are opposite mirror-images of the grippers 92, so that the pivotal movements of the rows of grippers P1 and P2 are symmetrically opposite with respect to the central plane 141 of the carriage 41 (see FIGS. 10 and 11).

Figure 17:
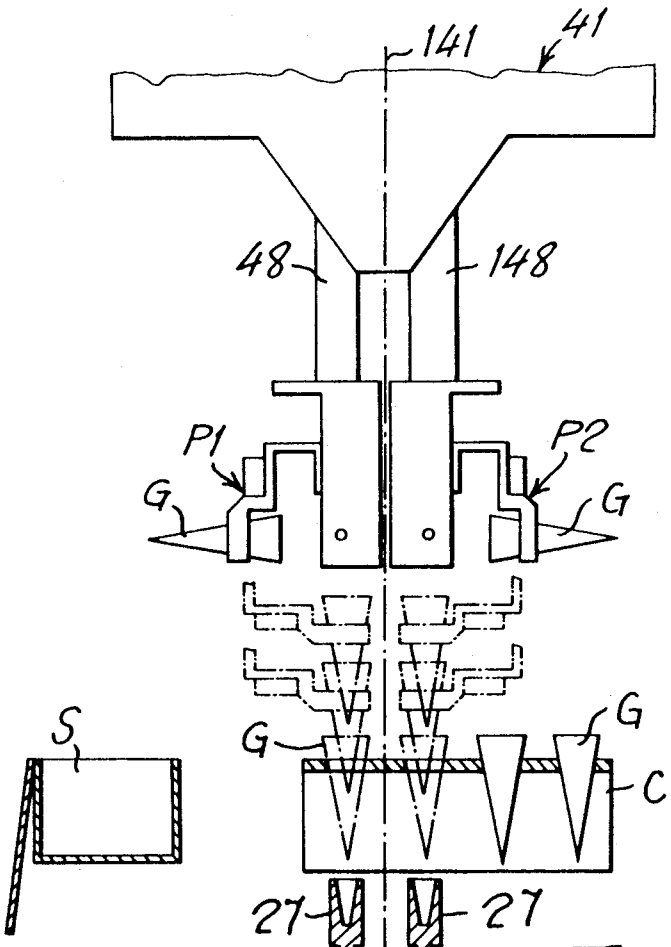

At the beginning of each working cycle, the grippers P1 and P2 are equally spaced apart as seen in FIG. 3 and are in a lifted, vertical and opened condition as shown with solid lines in FIG. 17. The trans-elevator assembly carrying the two rows of grippers P1–P2, moreover, is positioned so that the downwards extension of said central plane 141 is equally spaced from the two longitudinal adjacent rows of ice cream cones G to be withdrawn from the baskets C.

While the two rows of ice cream cones G are lifted from the respective rows of cups 27, the slides 48–148 are timedly lowered and the two rows of grippers P1–P2 are rotated through 90° and are disposed horizontally to pick up said ice creams when lifted. The grippers are then closed to clamp the ice cream cones by means of their opposite jaws 110–111 which, by reaction, cause said ice cream cones to undergo a small axial displacement upwards whereby their tops will abut against the plate 122. After the ice cream cones have been clamped, while the cups 27 are moved down and pre-arranged to repeat their working cycle on the other two rows of ice cream cones (see below), the slides 48–148 are lifted and the rows of grippers P1–P2 are timedly rotated outwards through 90°, so as to dispose vertically as shown with solid lines in FIG. 17. As a result of this rotation, the ice cream cones clamped by the grippers P1 and P2 are moved to a horizontal-axis condition and are ready for packing into a box, as described with reference to FIG. 1.

FIG. 16 shows with solid lines an ice cream G as disposed in the seat of a basket C, with a vertical axis. In this same Figure, 93 indicates the skew pivotal axis of each structure 92–192 which carries one gripper P1 or P2 and which, for simplicity's sake, is supposed to be included in an imaginary vertical plane including the same axis of the ice cream and such as to intersect at A the edge of the top of said ice cream. As stated above, the angle X formed by the axis 93 with a horizontal line B is equal or substantially equal to the angle X formed between the generatrix of the ice cream G and a vertical line D. If the ice cream G is rotated through 90° as from FIG. 16, about the axis 93, the projection of the tip Z of said ice cream will superpose the point A and the top of the ice cream will dispose as indicated with broken lines. If, after said rotation, the ice cream G is seen in top plan view, it appears as from FIG. 16*a* and the generatrix which was perpendicular to the axis 93 is now disposed horizontally and perpendicularly to the imaginary vertical plane including said skew axis 93.

Figure 23:
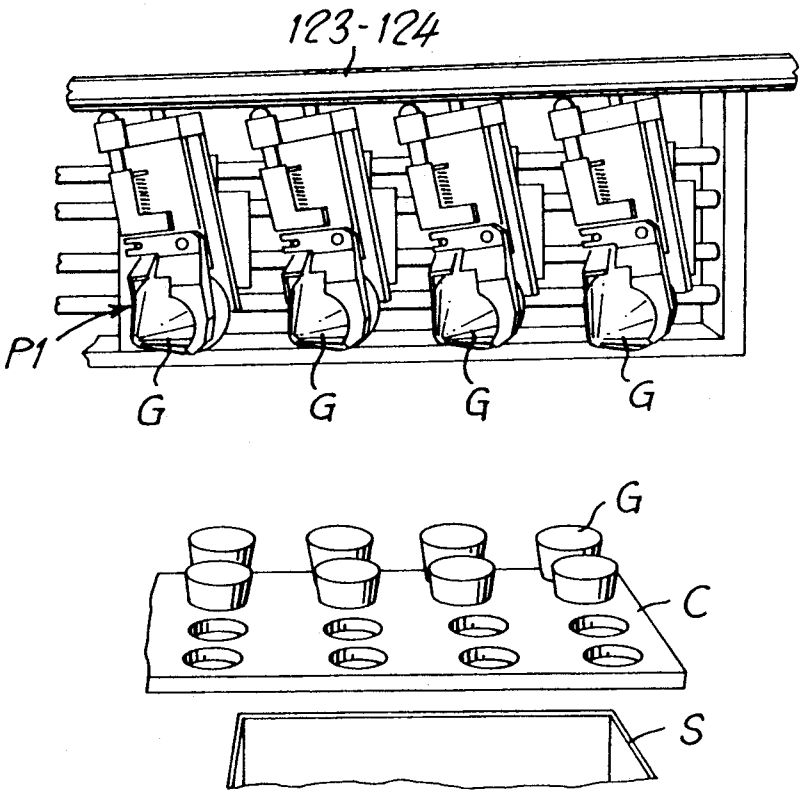

FIG. 23 shows a group of four grippers P1 after the upward rotation, as discussed above.

Figure 24:
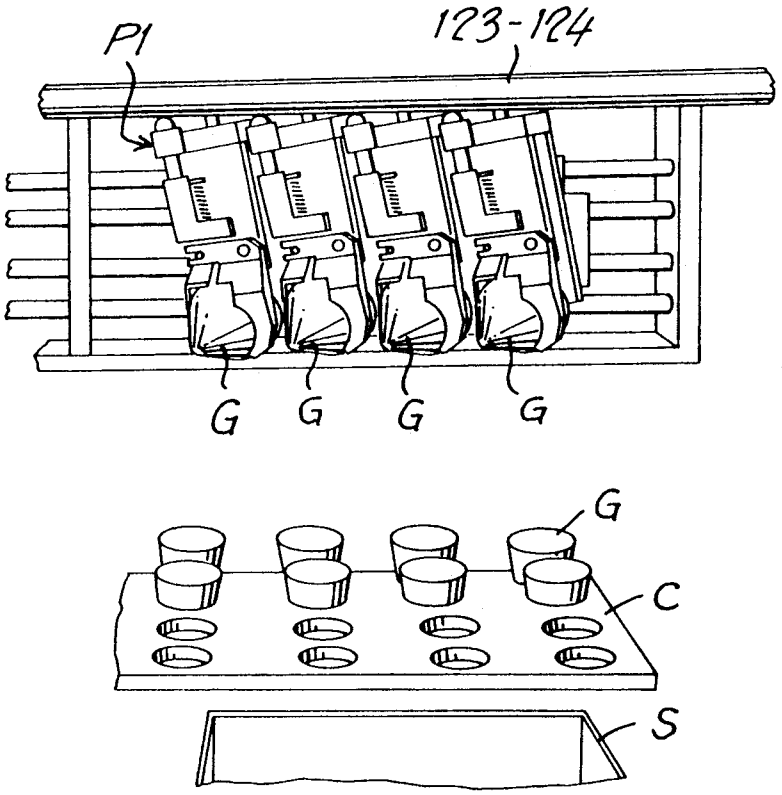

After the step which is shown in FIGS. 17 and 23, the grippers P1 and P2 are gathered four by four, as shown in FIG. 24, with activation of the cylinder-and-poston units 80–81 of FIG. 9. The ice cream cones are thus gathered four by four and pre-arranged so that each group of four ice cream cones may be introduced into one of the three boxes S standing by at the filling station of the machine.

Figure 18:
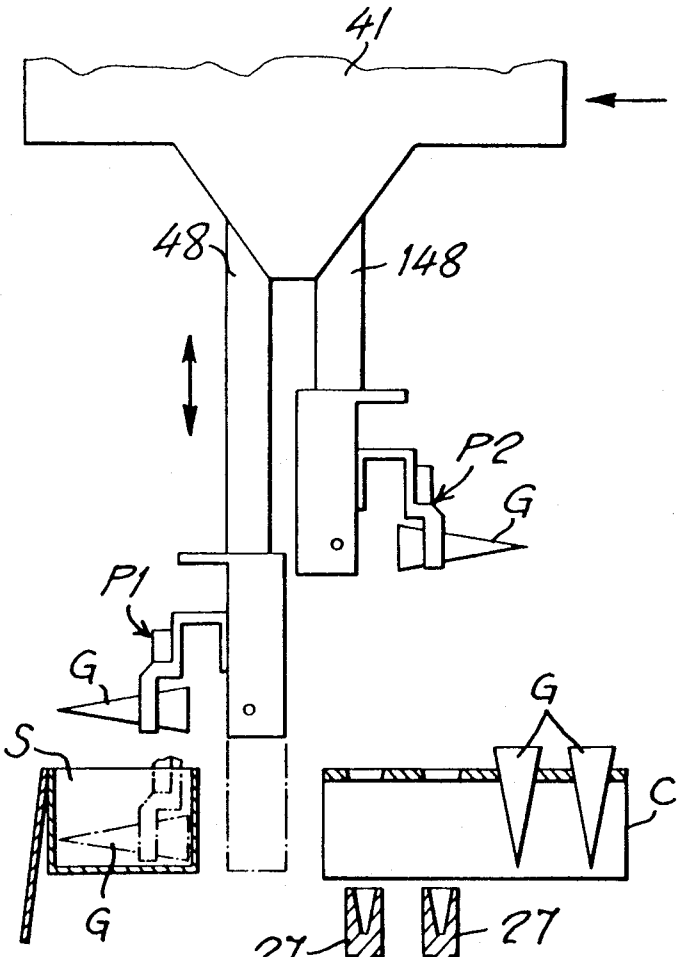
Figure 25:
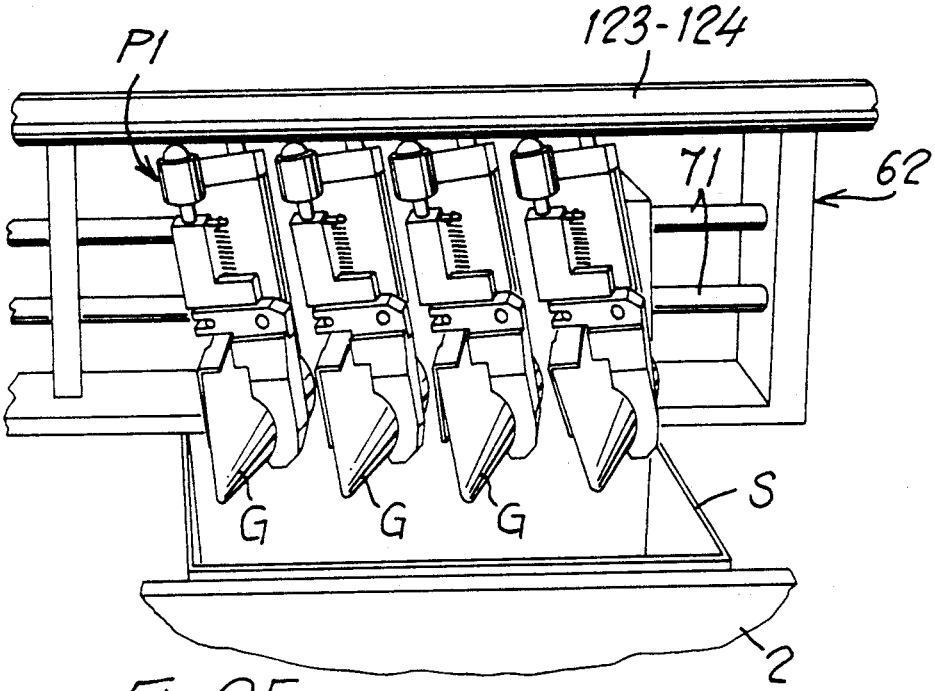

As shown in FIGS. 18 and 25, the carriage 41 is moved in the direction of the boxes S to dispose on each of them a group of four ice cream cones supported by the gripper P1, the arrangement being such that the slide 48 effects a timed descending movement to bring the ice cream cones near said boxes.

Figure 26:
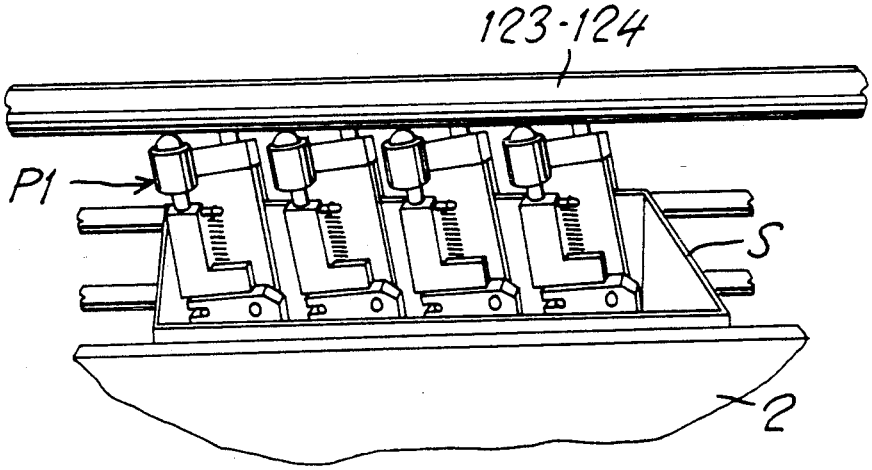

In the successive step—as shown with broken lines in FIG. 18 and as shown in FIGS. 25 and 26, after the carriage 41 has stopped—the slide 48 moves down farther to introduce the three groups of ice cream cones into the respective boxes S, to a short distance from the bottom of said boxes. Here, the grippers P1 are opened and the ice cream cones will dispose in the boxes as shown with broken lines in FIG. 1.

Figure 1:
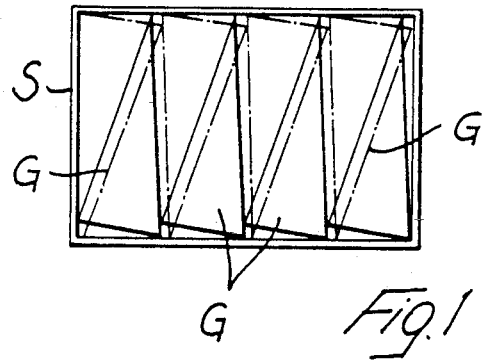
FIG. 1 is a plan view of the arrangement of the first and second layers of ice cream cones in a box.
Figure 19:
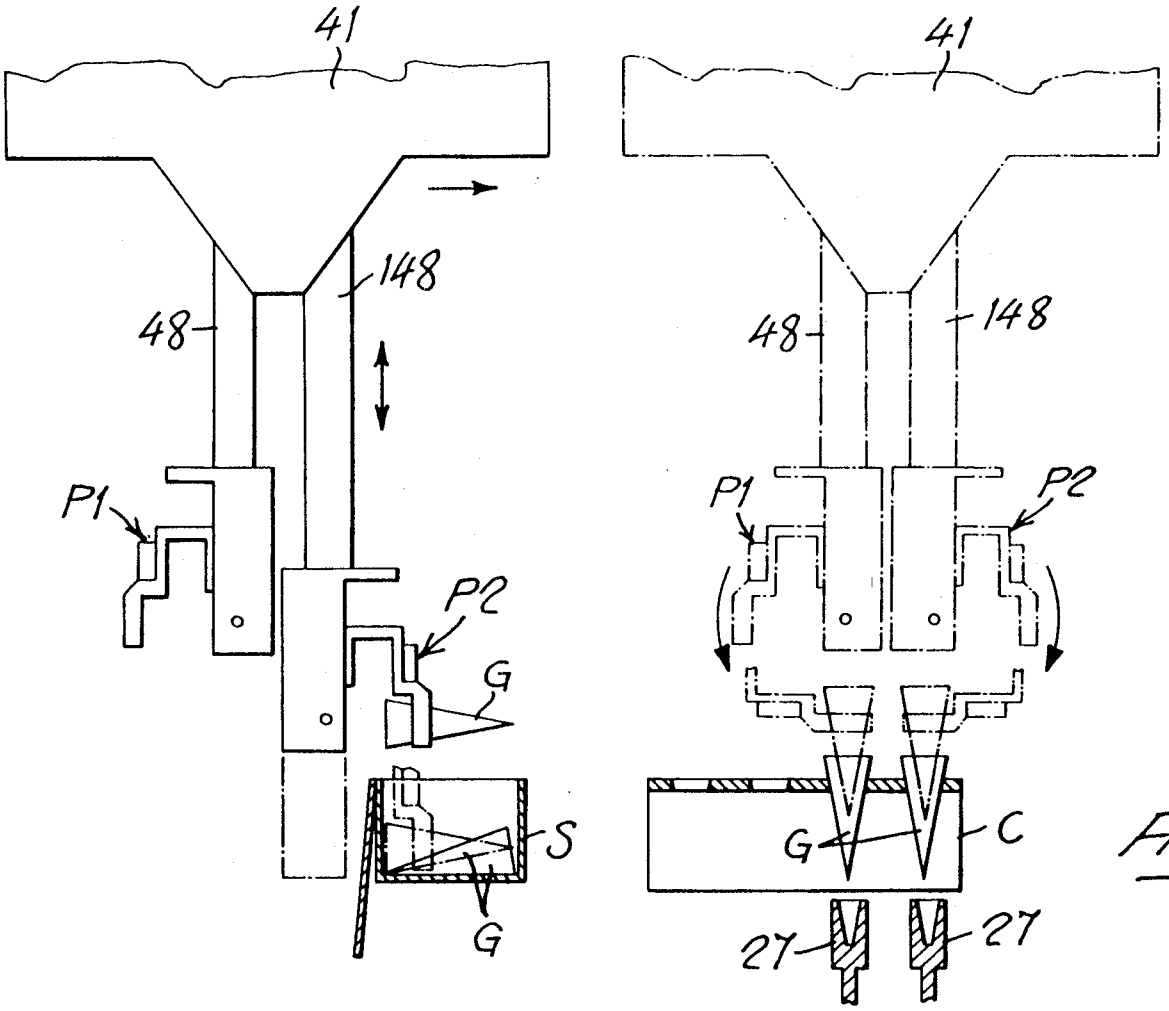

In the successive step, the slide 48 is returned to the upper initial position and when the grippers P1 have withdrawn from the boxes, the carriage 41 resumes its translational movement to dispose in a centered relation on the boxes S the four groups of ice cream cones which are supported by the grippers P2, as shown in FIG. 19 with solid lines. After the carriage 41 has stopped, the slide 148 is moved down to arrange the ice cream cones in the box when the grippers P2 will be opened, as shown with broken lines. A second layer is thus formed of ice cream cones G which will be disposed oppositely to the ice cream cones of the first layer and between them, as shown in FIG. 1 with solid lines.

Figure 20:
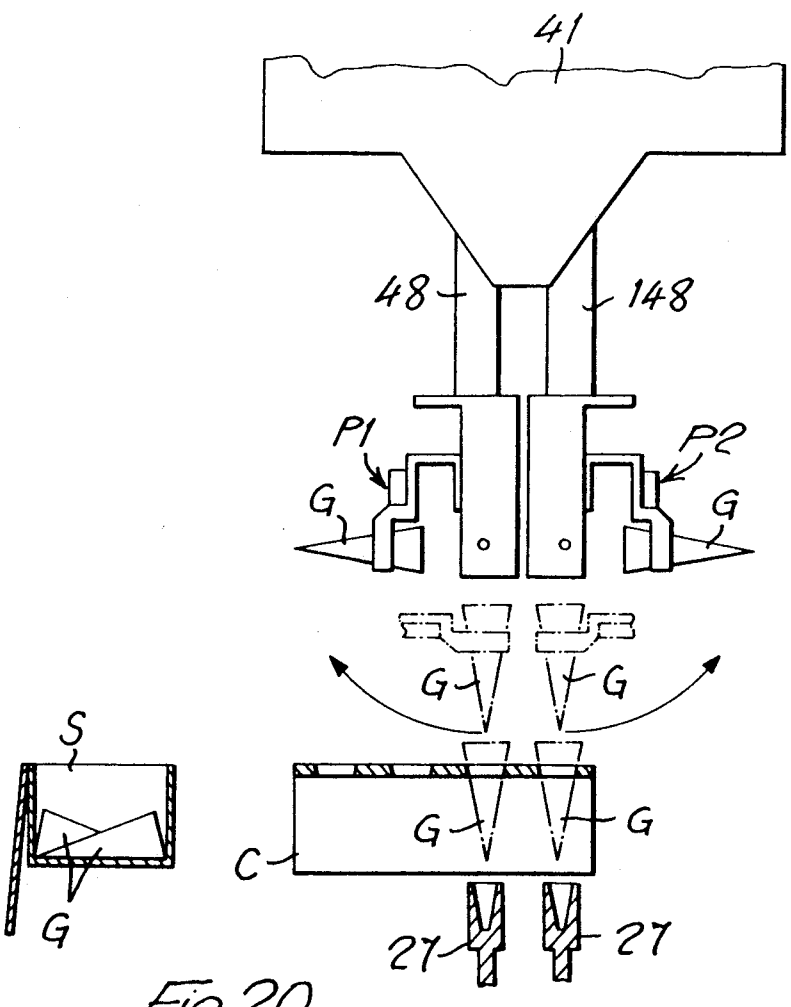

In the successive step, the slide 148 is returned to the upper position at the same level as the slide 48 and the carriage 41 is translated to return the grippers P1–P2 over the other two rows of ice cream cones which have remained in the baskets C as shown with broken lines in the right hand portion of FIG. 19. The succession of steps described with reference to FIG. 17 is then repeated. The ice cream cones are lifted by the conical cups 27 from the baskets C, they are clamped by the grippers P1–P2 and are then rotated horizontally and are gathered four by four, as shown in FIG. 20.

Figure 21:
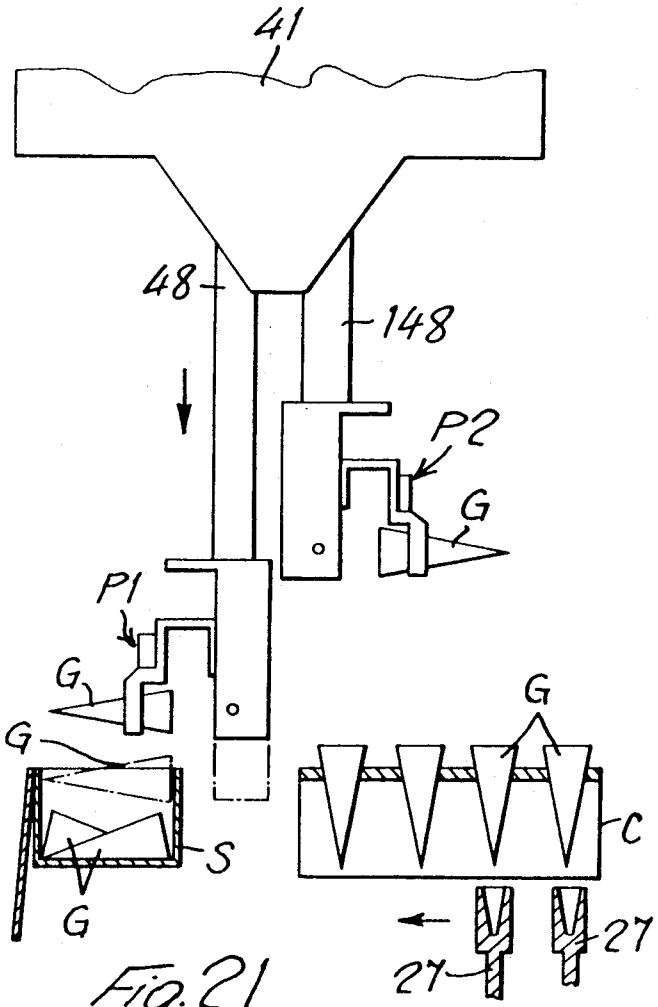
Figure 22:
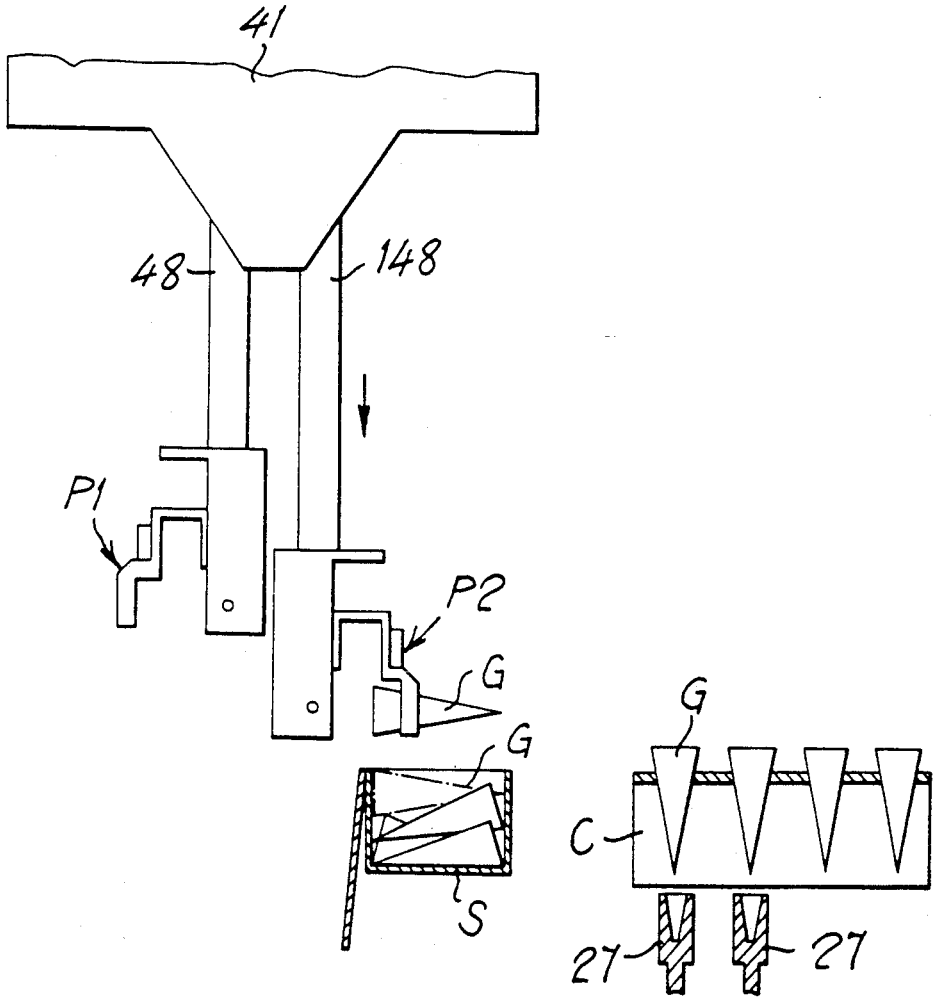

FIGS. 21 and 22 show how, by the successive translatory movement of the carriage 41 and by the descent of the slide 48 and then of the slide 148, the third and fourth layers of ice cream cones will be packed into the boxes S and will be superposed, respectively, on the first and second layers packed in the previous steps. The means controlling the descent of the slides 48–148 are pre-set to stop this descent so that the grippers and ice cream cones supported thereby will not interfere with the previously-packed ice cream cones. FIG. 3 shows how this condition can be granted by a set of sensors arranged at different levels.

Finally, from FIG. 22 it can be seen that, while the filling of the boxes S is being completed, the empty baskets C are removed and are replaced with baskets filled with ice cream cones, the lifting cups 27 being pre-set under them.

After being filled up, the three boxes S which were stationary in the machine are removed, are closed in a known manner are replaced with three other empty boxes.

We claim:

1. A method of packing into boxes edible ice cream cones which are arranged in conventional type baskets from the production cycle where said ice cream cones are arranged in a vertical position with their tips downwards and where they are aligned in at least two rows, comprising the steps of:

positioning at least one basket with the ice cream cones, in a position with at least one empty box which is open upwards and is adapted to contain any number of layers of said ice cream cones;

lifting and removing two parallel rows of ice cream cones from their seats in the basket, wherein each row comprises a number of ice cream cones which is required to form at least one layer thereof in the box;

rotating the two rows of ice cream cones together, upwards and in opposite directions through 90°, so that on completion of said rotation, said ice cream cones will be disposed with their axes in a horizontal condition, and with their tips at the outer side of the two rows and with their horizontal generatrix disposed perpendicularly with respect to the imaginary vertical plane containing the longitudinal axes of each row of ice cream cones;

moving the ice cream cones of each of the two rows towards each other, to gather and arrange the cones according to a mutual spacing as required for packing in a box;

moving the two rows of ice cream cones toward the box;

introducing one row into said box; and introducing the second row of ice cream cones into the box to form the second layer, whereby the tips of the ice cream cones in the first layer are disposed at one side of the box, while the tips of the ice cream cones in the second layer are disposed at the opposite side of said box, and whereby the tips and the tops of the second layer of ice cream cones are arranged between the tops and the tips, respectively, of the ice cream cones in the first layer.

2. A method according to claim 1, wherein a plurality of baskets and a plurality of boxes are simultaneously submitted to said emptying and filling, respectively, so that each of the two rows of ice cream cones which are cyclically removed from the baskets, then orientated and gathered, comprises a number of ice cream cones which is required to form a layer in all the boxes which are simultaneously being filled.

3. A method according to claim 1, wherein the rotation undergone by the ice cream cones of the two rows, after being removed from their seats in the supporting baskets, is carried out by rotating said ice cream cones of each row through substantially 90° about respective axes lying in a common imaginary vertical plane which is parallel to the plane containing the longitudinal axis of the row, said axes being suitably inclined in the same direction and by the same amount with respect to a common imaginary horizontal plane.

4. A method according to claim 3, wherein the inclination, with respect to the horizontal imaginary plane, of the axis about which the rotation of each ice cream cone is effected after its removal from the basket, is equal or substantially equal to the inclination of the generatrix of the ice cream cone with respect to the axis of said ice cream cone.

5. A machine for packing edible ice cream cones into boxes, said ice cream cones being arranged in the conventional type baskets from the production cycle where said ice cream cones are orientated with their axes vertical, with their tips downwards and where they are aligned in at least two rows, comprising:

means for conveying in single file the baskets with the ice cream cones and for positioning and locking said baskets, in a suitable number, at an emptying station;

means for conveying empty boxes in single file and for positioning and retaining them, in a suitable number and equally spaced from each other, at the filling station by the side of the basket emptying station;

optional means for lifting, under command, two parallel longitudinal rows of ice cream cones from their seats in the baskets, each row comprising a number of ice cream cones which is required to build up one layer in each box which is kept still at the filling station;

two rows of grippers which clamp the two rows of ice cream cones lifted from the baskets and which submit said rows of ice cream cones to rotation together about an axis which is parallel to the longitudinal axis of said rows, upwards, in opposite directions and through an angle of 90°, whereby on completion of said rotation said ice cream cones will be disposed with their axes horizontal, with their tips at the outer side of said rows and with the horizontal generatrix perpendicular to the vertical imaginary plane containing the longitudinal axis of each row of ice cream cones;

means for gathering horizontally the ice cream cones of each row to form as many groups as are the boxes to be filled and for pre-arranging each group of ice cream cones with the plan-view dimensions as required for packing into the boxes; and means for permitting lifting, lowering and transferring movements which are required first to cause said grippers to co-operate with said baskets for withdrawing the ice cream cones, and then to cause said grippers to co-operate successively with said boxes to introduce thereinto the groups of ice cream cones with different orientations.

6. A machine according to claim 5, wherein the means for lifting the rows of ice cream cones from the baskets to pre-arrange them for clamping by the orientating and packing grippers, comprises two ranges of conical cups acting on the tips of the ice cream cones and mounted, with the intermediary of a ball joint to match the ice cream cones, on the upper end of vertical rods which are axially movable in respective guides carried by lifting and lowering means supported by a carriage which can be translated by further means to align said rods to the rows of ice cream cones to be lifted, resilient means being provided to normally keep said rods in a lifted condition, with their lower heads abutting against the lower portion of the respective guides, said lower heads being provided with projecting extensions arranged at a short distance from bars which, after a suitable delay with respect to the lifting of the rods, are inserted over said extensions to stop the rods which have not been lifted due to the presence of ice which causes the ice cream cones to be lifted to stick to the basket, the arrangement being such that at the same time the rods are lowered said safety bars are neutralized.

7. A machine according to claim 6, wherein the safety bars preventing the rods from moving axially, in case they encounter a resistance in an ice cream to be lifted, are pivotably mounted on a supporting structure secured to the transferring carriage which carries the lifting-lowering means for said rods, said bars being arranged between the two rows of rods, said bars being interconnected by levers for self-centering movement and by further levers being pre-arranged to receive the required pivotal movement first for action and then for neutralization, by a linear cam arranged at one side of the slide carrying the guides of said rods.

8. A machine according to claim 5, wherein the rows of grippers used to pick up the ice cream cones and transfer them into the packing boxes are mounted on the lower ends of two vertical slides, which, by the action of rods or equivalent means, co-operate with guide supports secured to the opposite faces of a plate arranged in the center plane of a carriage which slides on horizontal guides supported by the frame of the machine and which, by the action of suitable drives for accurate and controlled displacement, can be translated to align the grippers first with the baskets for withdrawing the ice cream cones and then with the boxes for packing said ice cream cones thereinto, said vertical slides being actuated by respective means for vertical displacement.

9. A machine according to claim 8, wherein said vertical slides carrying the two rows of grippers for handling the ice cream cones are provided with vertical guides co-operating with carriages which are connected to the means for lifting/lowering said guides, the arrangement being such that said means can freely operate even when the lowering of said guides is prevented by any obstacle.

10. A machine according to claim 9, further comprising, on the translation carriage, fluid-operated cylinder-and-piston units urging upwards the vertical slides carrying the rows of grippers for handling the ice cream cones, by a force slightly smaller than the weight of said slides and parts associated therewith, to reduce the effect of inertia in the displacement of these assemblies.

11. A machine according to claim 5, wherein each of the vertical slides carrying one row of grippers for handling the ice cream cones supports the intermediate portion of a horizontal structure which, in turn, longitudinally carries horizontal guides slidably mounting sliding blocks in the same number of groups as are the boxes which are simultaneously concerned with the filling step, and the sliding blocks of each group being in the same number as the ice cream cones forming one layer in the filling step of a box and each sliding block having a gripper associated therewith, there being provided, parallelly to said guides and slidably supported by the same structure, a pair of rods selectively actuated by cylinder-and-piston units and said rods having secured thereto, respectively, the first and the last sliding blocks of each group and the same rods having secured thereto shoulders which, when the first and the last of said sliding blocks are spaced apart to pre-arrange the grippers for co-operating with the baskets, displace the intermediate sliding blocks and bring them into cooperation with fixed stops, pre-arranging also the grippers associated with said sliding blocks for cooperation with the baskets, whereby, when the terminal sliding blocks of each group are approached to each other, said sliding blocks engage the intermediate sliding blocks and all of them are gathered against fixed stops to pre-arrange the grippers for cooperation with the boxes, each sliding block having fulcrumed thereon the end of a U-shaped structure the other end of which carries a gripper, said structures of the two rows of grippers being arranged in opposite mirror-image position, said fulcrum axes of each row of said structures being arranged on the same imaginary vertical plane containing the longitudinal axis of said row and being inclined in the same direction and by the same amount with respect to a common imaginary horizontal plane, preferably with the same angular spacing existing between the generatrix of an ice cream cone and the axis of said ice cream cone, a most overhanging portion of said structures being provided with a roller or equivalent means co-operating with a grooved guide which is supported, parallel to the longitudinal axis of the row of grippers, by a composite structure which is supported at the ends thereof, so as to be pivotable on a shaft parallel to said longitudinal axis of the row, by the frame which supports the sliding blocks of the grippers, precision means being provided to cause the composite structure to rotate through 90° so as to dispose the grippers either horizontally for clamping the ice cream cones which have been lifted from the baskets, or directed downwards as required to introduce the suitably oriented and gathered ice cream cones into the respective packing boxes.

12. A machine according to claim 11, characterized in that each gripper for handling the ice cream cones comprises a flat stationary jaw acting somewhat tangentially on a portion of the side surface of an ice cream cone, which is skimmed by said gripper during the step when the grippers, already positioned on the baskets and opened, are rotated downwards to clamp the previously lifted ice cream cones, said stationary jaw having oppositely associated therewith a jaw which is movable towards and away from said stationary jaw, said movable jaw being either coated with or made of non-adhesive material and being shaped so as to engage over an arc of its circumference a portion of the side surface of an ice cream cone oppositely to the portion which is engaged by said stationary jaw, said movable jaw being, for example, interfulcurmed on the body of the gripper and being urged to the open condition by a resilient means which keeps the ball-joint end of a rod which is guided and kinematically connected to the movable jaw, permanently contacting with an eccentric shaft which is parallel to the longitudinal axis of the row of grippers and rotatably supported by the pivotable and power-driven structure which effects the 90° rotation of the rows of grippers, said structure having overhangingly secured thereto a small group for rotating said eccentric shaft, each gripper being completed by a fixed plate which is abutted by the top of an ice cream cone which, while being clamped by the gripper, reacts to the side clamping with a small axial displacement.

* * * * *